US011162480B2

(12) United States Patent
Wang et al.

(10) Patent No.: US 11,162,480 B2
(45) Date of Patent: Nov. 2, 2021

(54) VARIABLE STROKE PUMP

(71) Applicant: CW HOLDINGS LTD., Acheson (CA)

(72) Inventors: Jianke Wang, Conroe, TX (US); Leslie Wise, Acheson (CA); Xiaonan Zhai, Humble, TX (US); Ronald G. Embry, Jr., Woodbridge, VA (US); Milton Anderson, Houston, TX (US)

(73) Assignee: CW HOLDINGS LTD, Acheson (CA)

( * ) Notice: Subject to any disclaimer, the term of this patent is extended or adjusted under 35 U.S.C. 154(b) by 193 days.

(21) Appl. No.: 16/624,861

(22) PCT Filed: Jun. 22, 2018

(86) PCT No.: PCT/US2018/039049

§ 371 (c)(1),
(2) Date: Dec. 19, 2019

(87) PCT Pub. No.: WO2019/005619

PCT Pub. Date: Jan. 3, 2019

(65) Prior Publication Data

US 2021/0140415 A1 May 13, 2021

Related U.S. Application Data

(60) Provisional application No. 62/525,499, filed on Jun. 27, 2017.

(51) Int. Cl.
*F04B 1/14* (2020.01)
*F04B 1/146* (2020.01)
(Continued)

(52) U.S. Cl.
CPC ..... *F04B 1/14* (2013.01); *F01B 3/0002* (2013.01); *F01B 3/0023* (2013.01); *F04B 1/146* (2013.01);
(Continued)

(58) Field of Classification Search
CPC .. F04B 1/14; F04B 1/146; F04B 1/148; F04B 1/295; F04B 25/04; F04B 27/1072;
(Continued)

(56) References Cited

U.S. PATENT DOCUMENTS 2,661,701 A 12/1953 Ferris
2,956,845 A 10/1960 Wahlmark
(Continued)

FOREIGN PATENT DOCUMENTS

WO 2019005619 A1 1/2019

OTHER PUBLICATIONS

Extended European Search Report dated Oct. 21, 2020, in related EP Application No. 18823071.8, filed Jun. 22, 2018.
(Continued)

*Primary Examiner* — Charles G Freay
(74) *Attorney, Agent, or Firm* — Hauptman Ham, LLP

(57) ABSTRACT

A variable stroke high pressure pump is disclosed. The pump uses a wobble plate design with dynamically variable tilt to provide continuous adjustment of pump stroke length and output. Dynamically variable tilt is accomplished using a linearly actuated tilt thruster rotationally coupled to the drive shaft to maintain a selected tilt of the wobble plate through the rotation of the wobble plate.

21 Claims, 20 Drawing Sheets

(51) Int. Cl.

| | |
|---|---|
| ***F04B 1/295*** | (2020.01) |
| ***F04B 25/04*** | (2006.01) |
| ***F04B 27/10*** | (2006.01) |
| ***F01B 3/00*** | (2006.01) |

(52) U.S. Cl.
CPC ..... *F04B 1/295* (2013.01); *F04B 25/04* (2013.01); *F04B 27/1072* (2013.01); *F01B 3/00* (2013.01); *F01B 3/007* (2013.01)

(58) Field of Classification Search
CPC ..... F01B 3/00; F01B 3/0002; F01B 3/0003; F01B 3/007
USPC ..... 92/13
See application file for complete search history.

(56) References Cited

U.S. PATENT DOCUMENTS

| | | | | |
|---|---|---|---|---|
| 2,968,961 | A | 1/1961 | Mcgregor | |
| 3,009,422 | A | 11/1961 | Davis et al. | |
| 3,221,564 | A | 12/1965 | Raymond | |
| 3,223,042 | A | 12/1965 | Thresher | |
| 3,319,874 | A | 5/1967 | Welsh et al. | |
| 3,861,829 | A | 1/1975 | Roberts et al. | |
| 4,095,921 | A | 6/1978 | Hiraga et al. | |
| 4,784,045 | A | 11/1988 | Terauchi | |
| 6,957,604 | B1 * | 10/2005 | Tiedemann ..... | F04B 1/295 417/222.1 |
| 9,429,147 | B2 * | 8/2016 | Suzuki ..... | F04B 1/295 |
| 2005/0058551 | A1 | 3/2005 | Wakita et al. | |
| 2014/0127044 | A1 | 5/2014 | Yamamoto et al. | |
| 2014/0169987 | A1 | 6/2014 | Du | |
| 2015/0219215 | A1 | 8/2015 | Yoshimura et al. | |

OTHER PUBLICATIONS

International Preliminary Report on Patentability dated Oct. 22, 2019, in PCT/US2018/039049, filed Jun. 22, 2018.
International Search Report and Written Opinion dated Sep. 13, 2018, in PCT/US2018/039049, filed Jun. 22, 2018.
International Search Report and Written Opinion dated Sep. 13, 2018 in International Application No. PCT/US2018/039049, filed Jun. 22, 2018.
Notification of Transmittal of the International Search Report and the Written Opinion of the International Searching Authority, or the Declaration, dated Jul. 27, 2020 in International Application PCT/US2020/029213.

* cited by examiner

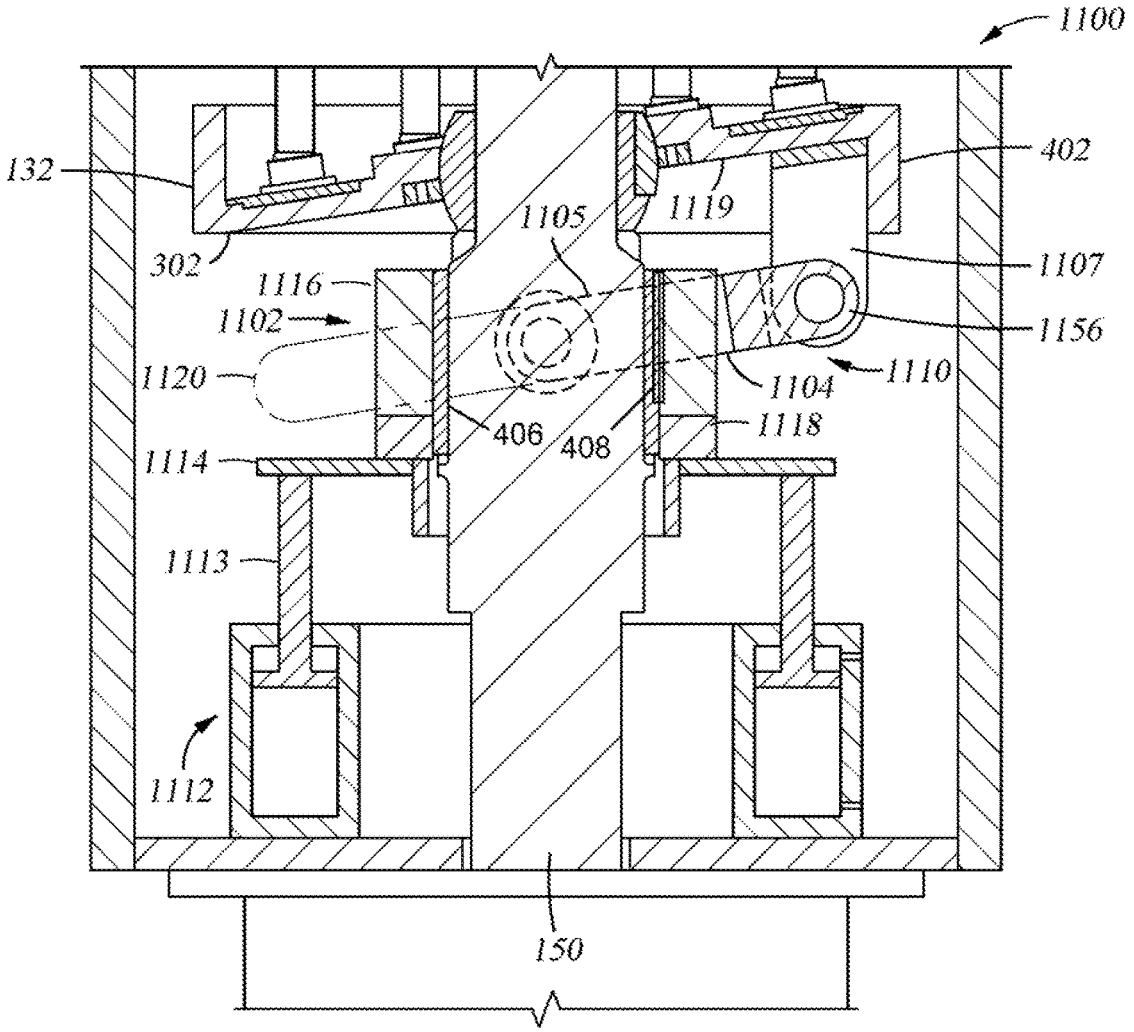
Fig. 11A
Fig. 11B
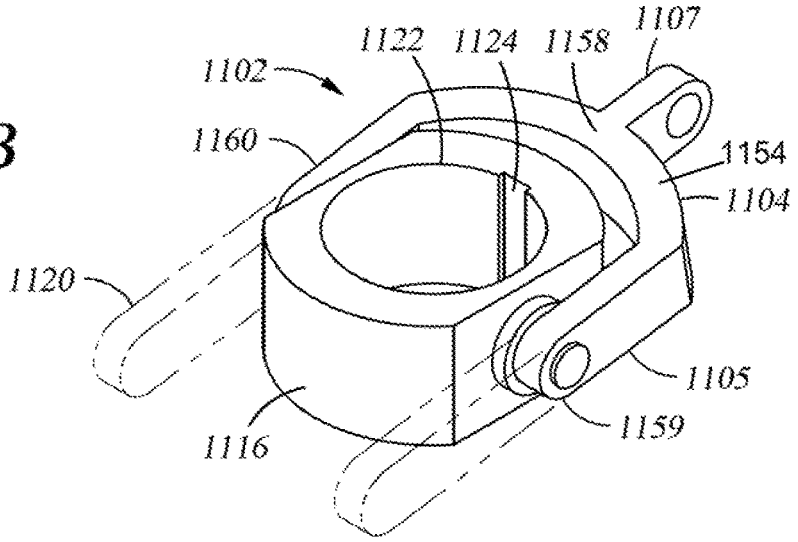

VARIABLE STROKE PUMP

CROSS REFERENCE

This application is a U.S. National Phase under 35 U.S.C. § 371 of International Application No. PCT/US2018/039049, filed on Jun. 22, 2018 which claims the benefit of U.S. Provisional Application No. 62/525,499, filed on Jun. 27, 2017, the entire contents of both are hereby incorporated by reference.

FIELD

Embodiments described herein relate to high pressure pumps used in oil and gas service.

BACKGROUND

Production of oil and gas is a trillion-dollar industry. Producers continually seek ways to increase the speed and flexibility, and lower the cost of, production apparatus for onshore and offshore oil and gas production. Equipment downtime is costly, so efficient repair and replacement of equipment in the field is valuable. High pressure pumps are routinely used in oil and gas service to pump various fluids, such as processing fluids, hydraulic fracturing fluids, and flush fluids through hydrocarbon reservoirs. Failure of such a pump shuts down production.

Typically, high pressure pumps are switched on and off when needed. Such power cycling reduces the lifetime of the pump. Additionally, different pumps are typically used for different service requiring different pressure. High pressure pumps capable of producing varying pressures and capable of idling without being shut off, are needed in the industry.

SUMMARY

Embodiments described herein provide a pump, comprising a drive shaft coupled to a drive; a wobble plate attached to the drive shaft by a swivel mount with a wobble plate key extending radially outward from the swivel mount; a plurality of displacement rods, each having a first end and a second end, with the first end of each displacement rod disposed against a first surface of the wobble plate and the second end of each displacement rod connected with a plunger; a tilt disk disposed around the drive shaft, the tilt disk having an inner radius with a radial slot formed therein and a thruster extending toward a second surface of the wobble plate opposite the first surface; a tilt disk key extending radially outward from the drive shaft and mated with the radial slot; and a hydraulic actuator slidably disposed against the tilt disk.

Other embodiments provide a pump, comprising a drive shaft coupled to a drive; a wobble plate attached to the drive shaft by a ball-shaped swivel mount with a wobble plate key extending radially outward from the swivel mount; a plurality of displacement rods, each having a first end and a second end, with the first end of each displacement rod disposed against a first surface of the wobble plate and the second end of each displacement rod connected with a plunger; a thrust bearing between each displacement rod and the wobble plate; a tilt disk disposed around the drive shaft, the tilt disk having an inner radius with a radial slot formed therein and a thruster extending toward a second surface of the wobble plate opposite the first surface; a tilt disk key extending radially outward from the drive shaft and mated with the radial slot; and a hydraulic actuator slidably disposed against the tilt disk.

Other embodiments provide a pump, comprising a drive shaft coupled to a drive; a wobble plate attached to the drive shaft by a ball-shaped swivel mount with a wobble plate key extending radially outward from the swivel mount; a plurality of displacement rods, each having a first end and a second end, with the first end of each displacement rod disposed against a first surface of the wobble plate and the second end of each displacement rod connected with a plunger; a thrust bearing between each displacement rod and the wobble plate; a tilt disk disposed around the drive shaft, the tilt disk having an inner radius with a radial slot formed therein and a thruster extending toward a second surface of the wobble plate opposite the first surface, the tilt disk attached to the drive shaft by a guide ring; a tilt disk key extending radially outward from the drive shaft and the guide ring, and mated with the radial slot; and a hydraulic actuator slidably disposed against the tilt disk.

Other embodiments provide a pump, comprising a drive shaft coupled to a drive; a wobble plate attached to the drive shaft by a swivel mount with a wobble plate key extending radially outward from the swivel mount; a plurality of displacement rods, each having a first end and a second end, with the first end of each displacement rod disposed against a first surface of the wobble plate and the second end of each displacement rod connected with a plunger; and a tilt actuator assembly disposed around the drive shaft, the tilt actuator assembly comprising a slider having an interior surface with a slot formed therein and a thruster coupled to the slider and extending toward a second surface of the wobble plate opposite the first surface, the tilt actuator assembly further comprising a key extending radially outward from the drive shaft and mated with the slot and a linear actuator slidably disposed against the slider.

Other embodiments provide a pump, comprising a drive shaft coupled to a drive; a wobble plate attached to the drive shaft by a ball-shaped swivel mount with a wobble plate key extending radially outward from the swivel mount; a plurality of displacement rods, each having a first end and a second end, with the first end of each displacement rod disposed against a first surface of the wobble plate and the second end of each displacement rod connected with a plunger; a thrust bearing between each displacement rod and the wobble plate; a tilt actuator assembly disposed around the drive shaft, the tilt actuator assembly comprising a slider with a slot formed therein and a thruster extending toward a second surface of the wobble plate opposite the first surface; a key extending radially outward from the drive shaft and mated with the slot; and a rack-pinion actuator slidably disposed against the slider.

Other embodiments provide a pump, comprising a drive shaft coupled to a drive; a wobble plate attached to the drive shaft by a ball-shaped swivel mount with a wobble plate key extending radially outward from the swivel mount; a plurality of displacement rods, each having a first end and a second end, with the first end of each displacement rod disposed against a first surface of the wobble plate and the second end of each displacement rod connected with a plunger; a thrust bearing between each displacement rod and the wobble plate; a tilt actuator assembly disposed around the drive shaft, the tilt actuator assembly comprising a slider with an interior surface that has a slot formed therein and a thruster extending toward a second surface of the wobble plate opposite the first surface, the slider attached to the drive shaft by a guide ring; a key extending radially outward from the drive shaft and the guide ring, and mated with the slot; and a hydraulic actuator slidably disposed against the slider.

BRIEF DESCRIPTION OF THE DRAWINGS

So that the manner in which the above-recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 11A is a schematic cross-sectional view of a pump power section according to another embodiment.

FIG. 11B is an isometric view of a tilt actuator assembly of the pump power section of FIG. 11A. To facilitate understanding, identical descriptors have been used, where possible, to designate identical elements that are common to the figures. It is contemplated that elements disclosed in one embodiment may be beneficially utilized on other embodiments without specific recitation.

DETAILED DESCRIPTION

Figure 1:
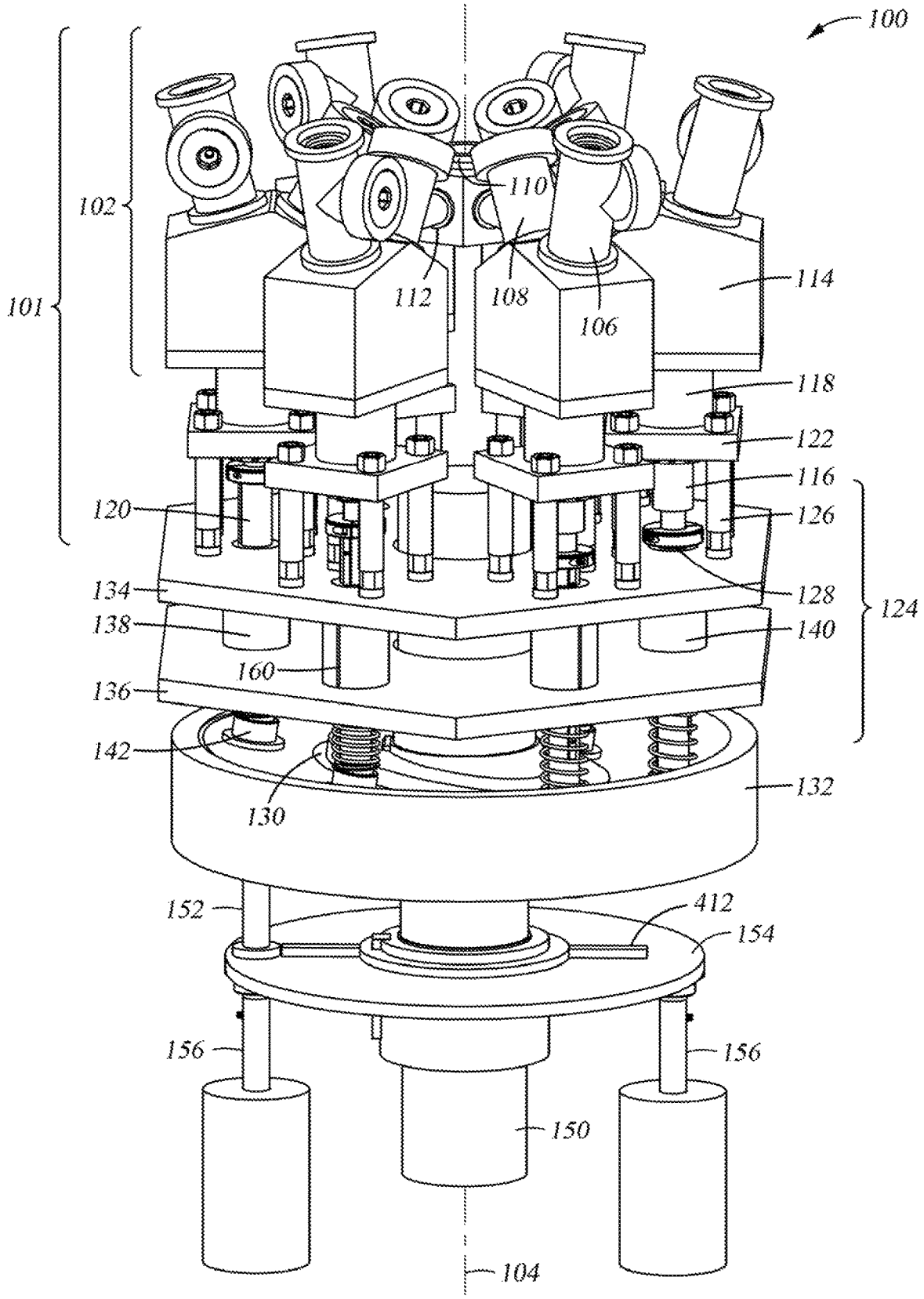
FIG. 1 is an external view of a variable stroke pump according to one embodiment.

FIG. 1 shows an external view of an assembled variable stroke reciprocating pump 100. The top portion of the figure shows the fluid end 101 of the pump 100. A plurality of module assemblies 102 is located around a central drive shaft axis 104, each module assembly 102 comprising at least one suction valve and one discharge valve. The suction valve, and its seat and spring, of each module assembly 102 are disposed in a suction valve cartridge 106, and the discharge valve, and its seat and spring, are disposed in a discharge valve cartridge 108. The valves themselves are therefore not visible in the external view of FIG. 1. The valve sets can be constructed such that fluid flow can only be in one direction; flow into the module assembly 102 in the case of the suction valves and flow out of the module assembly 102 in the case of the discharge valves. The discharge valve cartridge 108 of each of the module assemblies 102 may be fluidly coupled to a discharge manifold 110 for connecting the pump 100 to a piping system such that the working fluid energy in the form of hydraulic pressure is transferred to work in a desired application, such as hydraulic fracturing.

The suction and discharge valve cartridges 106 and 108 of each module assembly 102 are arranged such that the discharge valve cartridges 108 converge radially. The discharge valve cartridges 108 shown in the arrangement of FIG. 1 point radially inward toward the drive shaft axis 104 so that construction and location of the discharge manifold 110 is simplified. In this case, the discharge manifold 110 includes a plurality of radially arranged couplings 112 that direct fluid to a central discharge line (not shown) for the pump. Each discharge coupling 112 couples to one of the discharge valve cartridges 108, so that all the module assemblies 102 are connected toward the drive shaft axis 104 to the discharge manifold 110, and fluid is discharged from the pump along the drive shaft axis 104. With a similar discharge manifold design, the discharge valve cartridges 108 of the module assemblies can be connected to the discharge manifold with an azimuthal angle to create a rotating fluid flow in the discharge manifold 110, if desired.

Each module assembly has a pressure chamber 114 that joins the suction and discharge valve cartridges 106 and 108. In the pressure chamber 114 of each module assembly 102, the working fluid is subjected to pressurization by a reciprocating plunger 116 which extends and retracts inside the pressure chamber 114 through a plunger opening (not shown) in a wall (not shown in FIG. 1) of the pressure chamber 114 generally opposite the location of the suction and discharge valve cartridges 106 and 108. The plunger 116 reciprocates inside an optional plunger nozzle 118 connected to the pressure chamber 114 at the plunger opening.

Each plunger 116 is connected to a displacement rod 120 that couples the plunger 116 to the drive mechanism of the pump 100. Each plunger 116 and displacement rod 120 defines a displacement assembly for each module assembly 102. There may be any number of module/displacement assembly units in the pump, limited only by pump sizing and spacing requirements. The discharge manifold 110 is given couplings 112 to match the number of module/displacement assembly units in the pump.

Each module assembly 102 has an optional flange 122 at a distal end of the plunger nozzle 118, which is attached to a bearing plate assembly 124 using appropriate fasteners, in this case stay rods 126. In other cases, fasters such as bolts or studs may be used, and the flange 122 can be avoided by using a simple bore into the plunger nozzle 118 or the pressure chamber 114. The bearing plate assembly 124 includes a first plate member 134 located proximate the fluid end 101, a second plate member 136, and a plurality of spacers 138 between the first plate member 134 and the second plate member 136. Each spacer 138 is aligned with a bore 128 through the first plate member 134 and a bore 140 through the second plate member 136. Each displacement rod 120 extends through one of the bores 128, one of the aligned spacers 138, and one of the bores 140, to contact a first surface 130 of a wobble plate 132. Each displacement rod 120 is fitted with a thrust bearing 142 to provide substantially frictionless contact with the first surface 130. The wobble plate is tiltably attached to a drive shaft 150 of the pump 100, and rotates with the drive shaft 150 to power the reciprocating motion of the displacement assemblies.

A thruster rod 152 is disposed in contact with a second surface (not shown in FIG. 1) of the wobble plate 132, opposite from the first surface 130, and is used to dynamically tilt the wobble plate 132. The thruster rod 152 contacts the second surface of the wobble plate 132 by means of a thrust bearing (not shown in FIG. 1), and is mounted to a tilt disk 154. The tilt disk 154 is slidably attached to the drive shaft 150, rotates with the drive shaft 150, and is free to slide longitudinally along the drive shaft 150 to move the thruster rod 152. The tilt disk 154 is thus an example of a slider. The tilt disk 154 can be driven by hydraulically or pneumatically operated activator rods 156 as further described below. In other cases, the tilt disk 154 can be driven by a rack and pinion mechanism, as further described below. The tilt disk 154, activator rods 156, and drive mechanism form a tilt actuator assembly.

In general, the various thrust bearings described herein may be any kind of mechanical thrust bearing. A hydrostatic thrust bearing, such as a slipper shoe, may be used. Alternately, a hydrodynamic thrust bearing, such as a tilt pad, can be used. In other embodiments, roller bearings can be used. Examples of each kind of thrust bearing are described in various uses herein.

Figure 2:
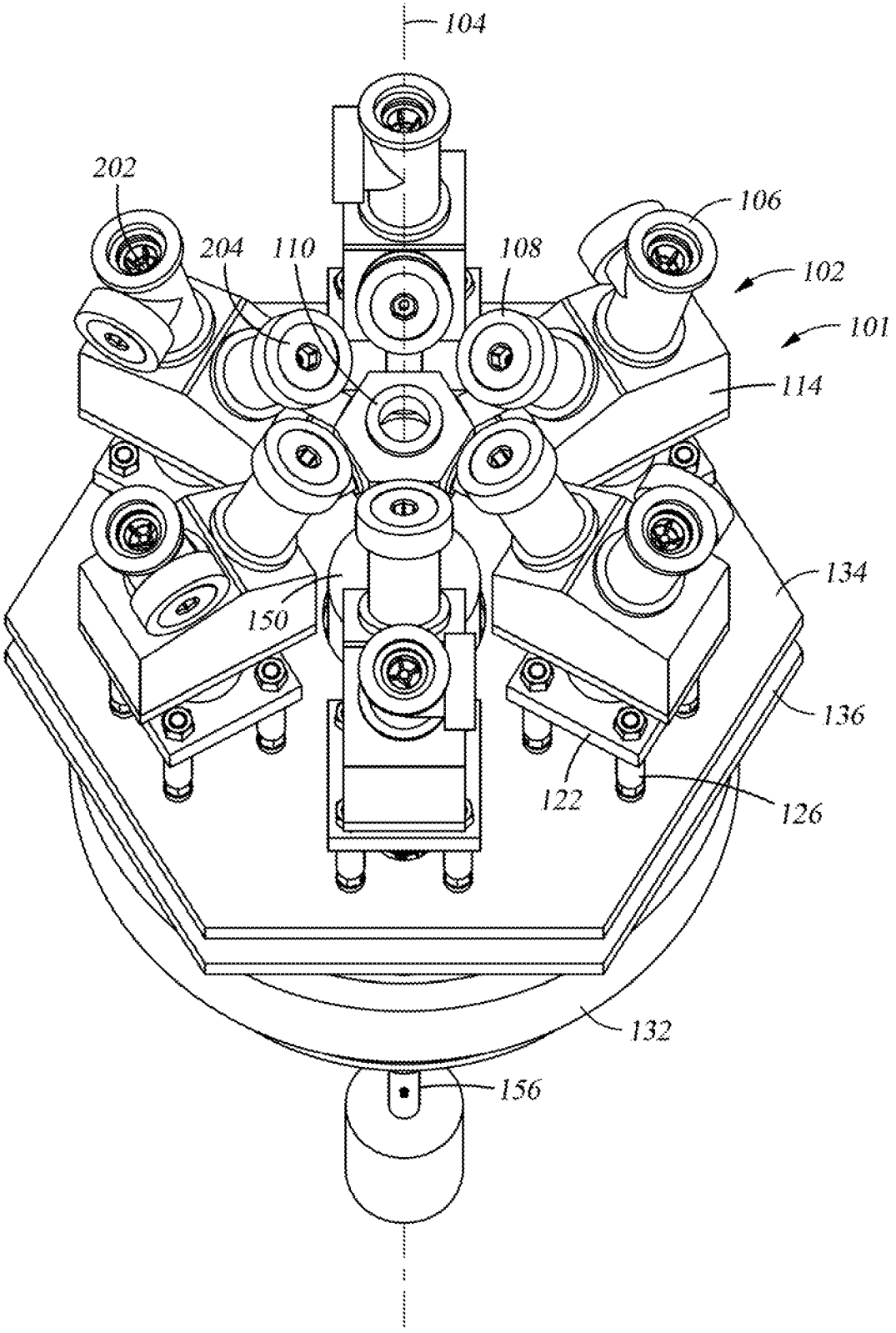
FIG. 2 is a top view of the variable stroke pump of FIG. 1.

FIG. 2 is a top view of the variable displacement pump 100 of FIG. 1 showing the module/displacement assembly units located radially around the drive shaft axis 104. The module assemblies 102 can be seen arranged with suction valve cartridges 106 located radially outward and discharge valve cartridges 108 located radially inward and coupled to the discharge manifold 110. In the pump 100, six module assemblies are provided, but as discussed above any number may be provided. Suction valves 202 can be seen in the suction valve cartridges 106, one valve for each suction valve cartridge 106. Discharge valves 204 can likewise be seen in the discharge valve cartridges 108. The drive shaft 150 protrudes through the bearing plate assembly 124 toward the fluid end 101, but may be shortened if desired. The first plate member 134 and second plate member 136 are shown having a hexagonal shape, but they may be any desired shape, including round and square.

Figure 3A:
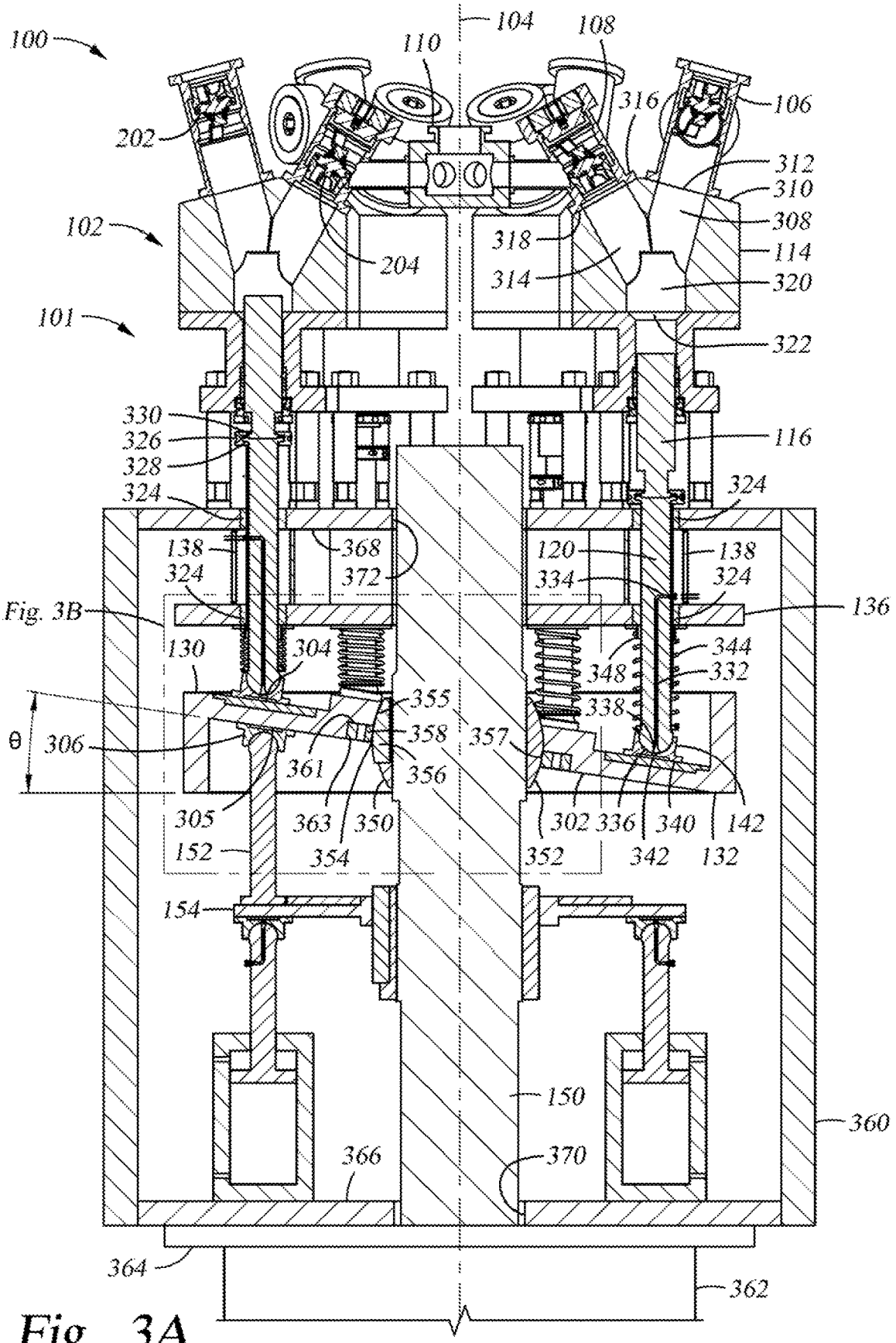
FIG. 3A is a cross-sectional view of the pump of FIG. 1 in one configuration.

FIG. 3A is a cross sectional view of the pump 100 of FIG. 1. The figure shows two of the module assemblies 102 and displacement rod 120, plunger 116 displacement assemblies, which, in FIG. 3A, happen to be in different stages of fluid compression due to their positions relative to the wobble plate 132. The wobble plate 132 is shown operating at a tilt angle θ, one of many possible such tilt angles. In one embodiment, the tilt angle θ may be 0 to about 12 degrees, for example 6 degrees.

The second surface 302 of the wobble plate 132 is shown in FIG. 3A. The displacement rod 120 contacts the first surface 130 at a first contact point 304, optionally mediated by a wear plate, as described further below. The thruster rod 152 contacts the second surface 302 at a second contact point 305. The first contact point 304 is opposite the second contact point 305 to align the thruster rod 152 with the power stroke of the pump 100. In this way, there is always a reaction force to the pressure of the thruster rod 152 on the wobble plate 132 so that when the thruster rod 152 retracts, the tilt angle of the wobble plate 132 declines toward zero.

The connection of the suction valve cartridges 106 with the discharge valve cartridges 108 in each module assembly 102 through the pressure chamber 114 is shown with a reciprocating plunger 116 operating in each pressure chamber 114 through the action of the displacement rod 120. Each pressure chamber 114 has an inlet channel 308 between an inlet portal 312 at an inlet surface 310 of the pressure chamber 114, and an outlet channel 314 between an outlet portal 316 at an outlet surface 318 of the pressure chamber 114, the inlet and outlet channels 308 and 314 joining at a junction 320 adjacent to an opening 322 from the plunger nozzle 118 into the junction 320.

The suction and discharge valves 202 and 204 are visible in cross-section for two of the module assemblies 102. The suction valves 202 are spring-biased closed to allow the suction valves 202 to open when pressure is reduced in the pressure chamber 114 and fluid pressure from the suction manifold can open the suction valves 202. The discharge valves 204 are spring-biased closed to allow increased pressure in the pressure chamber 114 to open them. In operation, when the plunger 116 retracts, pressure is reduced in the pressure chamber 114 and the suction valve 202 opens to admit fluid into the pressure chamber 114. When the plunger 116 advances into the pressure chamber 114, pressure increases, forcing the discharge valve 204 open to release liquid in the pressure chamber 114 to flow out into the discharge manifold 110.

The displacement rods 120 extend through the bores 128 and 140 in the first and second plate members 134 and 136 of the bearing plate assembly 124. A bushing 324 is disposed in each of the bores 128 and 140 to stabilize, and provide a non-destructive surface contact for, the displacement rods 120. Each displacement rod 120 is connected to a plunger 116 by a fitting 326, which in this case is a clamp fitting. The displacement rod 120 has a flange 328, and the plunger 116 has a flange 330. The flange 328 of the displacement rod 120 abuts the flange 330 of the plunger 116. The fitting 326 is disposed around the abutting flanges 328 and 330 of the plunger 116 and the displacement rod 120 to secure the two. As the displacement assembly, defined by the displacement rod 120 and the plunger 116, reciprocates, the fitting 326 moves between a position of maximum extension and maximum retraction. The length of the stay rods 126, which separates the first plate member 134 from the flange 122 of each module assembly 102, is set by the maximum displacement of the fitting 326 at maximum pump stroke, which corresponds to the maximum tilt angle of the wobble plate 132.

Figure 3B:
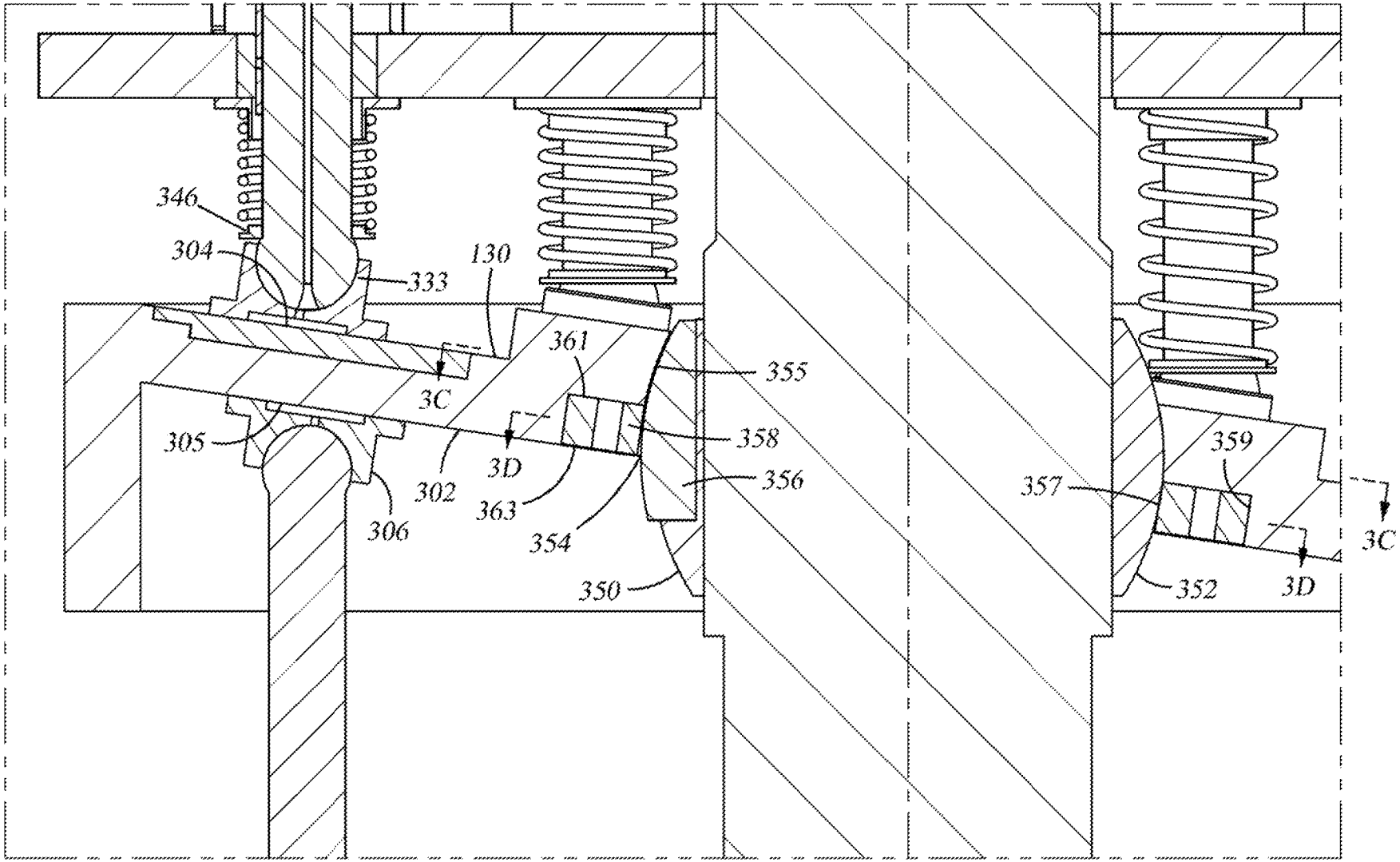
FIG. 3B is a detail view of a portion of the pump of FIG. 3A.

FIG. 3B is a detail view of the pump 100 shown in FIG. 3A. Each displacement rod 120 includes a lubricant passage 332 that extends from a lubrication port 334 formed in a side of the displacement rod 120, axially through and along the interior of the displacement rod 120, to the distal end 336 of the displacement rod 120. The distal end 336 has a rounded tip 333 that connects to the thrust bearing 142 by a ball-and-socket connection. The rounded socket of the thrust bearing 142, which contacts the rounded tip 333 of the displacement rod 120, has a lubricant port 338 that passes lubricant from the lubricant passage 332 to the first surface 130 (FIG. 3A) of the wobble plate 132. The lubricant passage 332 has an opening in the distal end 336 of the displacement rod 120 that is flared to maintain fluid connection between the lubricant passage 332 and the lubricant port 338 as the thrust bearing 142 rotates around the rounded tip 333 of the displacement rod 120. The thrust bearing 142 contacts the first surface 130 at a contact surface 340 that has a recess 342 for receiving lubricant through the lubricant port 338. The pool of lubricant provided to the recess 342 through the lubricant port 338 allows frictionless contact between the wobble plate 132 and the thrust bearing 142, enabling the wobble plate 132 to rotate with the drive shaft 150 while the displacement assemblies remain azimuthally stationary.

A spring 344 is provided between the thrust bearing 142 and the second plate member 136 (FIG. 3A) to bias the displacement rods 120 toward the wobble plate 132. The spring 344 is maintained in a state of compression at all times, so as the wobble plate 132 rotates to retract the displacement rod 120, the spring urges the displacement rod 120 toward the wobble plate 132, simultaneously retracting the displacement rod 120 and the plunger 116 from the pressure chamber 114. A ledge 346 may be provided where the rounded tip 333 of the displacement rod 120 meets the straight side of the displacement rod 120 to retain the spring 344 around the displacement rod 120. A collar 348 may be disposed against the second plate member 136 around the displacement rod 120 to protect the bushing 324 from contact with the spring 344 and wear arising from such contact.

Referring again to FIG. 3A, the wobble plate 132 is attached to the drive shaft 150 by a swivel mount 350. The swivel mount 350 includes a ball sleeve 352 disposed around and attached to the drive shaft 150. The wobble plate 132 has a central opening 354 sized to fit the ball sleeve 352. The inner wall of the central opening 354 has a curvature that matches the curvature of the ball sleeve 352. The wobble plate 132 is secured to the swivel mount 350 using a key 356 that fits a slot in the ball sleeve 352. The key 356 and slot are oriented parallel to the pump axis 104 such that the wobble plate 132 can swivel in the pump axis direction.

The wobble plate 132 is secured to the swivel mount 350 by a retainer plate 358. The retainer plate 358 fits within a recess 359 of the second surface 302 of the wobble plate 132. In the embodiment of FIG. 3A, the retainer plate 358 contacts the wobble plate 132 at a first surface 361, which contacts the second surface 302. A second surface 363 of the retainer plate 358 is coplanar with a portion of the second surface 302. The recess 359 is located at the center of the wobble plate 132 and is disposed immediately around the central opening 354. The retainer plate 358 also has a central opening 357 shaped to fit around the ball sleeve 352 with a matching curvature. The wobble plate 132 and the retainer plate 358 each have a slot, respectively 355 and 365, into which the key 356 extends. The slots 355 and 365 in each of the wobble plate 132 and the retainer plate 358 extend into the wall of the respective central openings 354 and 357. Thus, the retainer plate 358 secures the wobble plate 132 to the swivel mount 350 during assembly and operation of the pump 100.

Figure 3C:
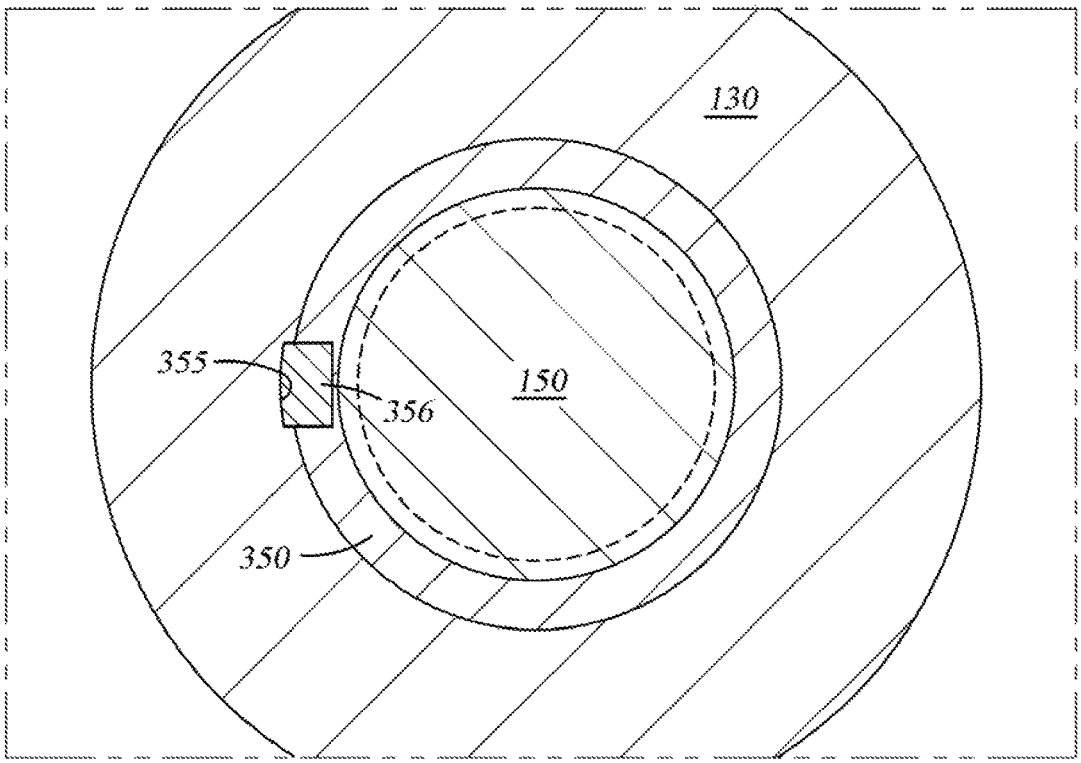
FIGS. 3C and 3D are cross-sectional views of portions of the pump of FIG. 3A.
Figure 3D:
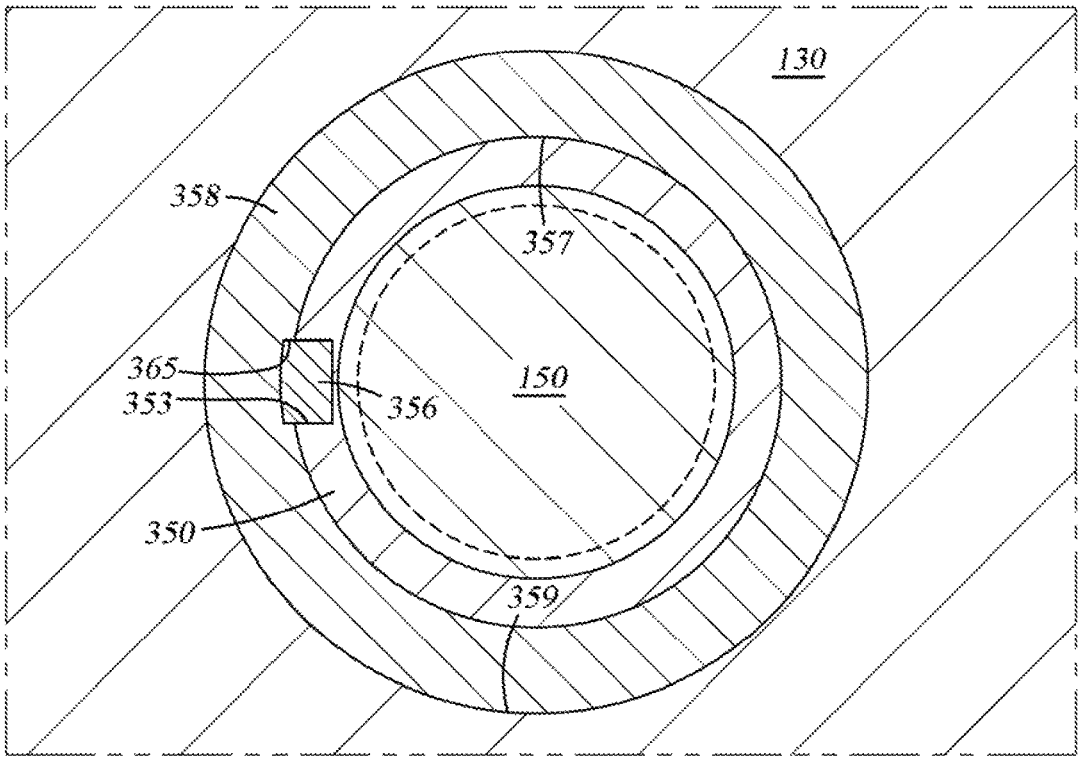

FIGS. 3C and 3D are cross-sectional views of the pump 100 of FIG. 3A showing the relationship of the slots 355 and 365, the key 356, the ball sleeve 350 and the retainer plate 358. FIG. 3C is a cross-sectional view showing how the key 356 interacts with the ball sleeve 350 and the wobble plate 132. The key 356 fits into the slot of the ball sleeve 350 and projects into the slot 355 of the wobble plate 132. FIG. 3D is a cross-sectional view showing how the key 356 interacts with the ball sleeve 350 and the retainer plate 358. The key 356 also projects into the slot 365 of the retainer plate 358. In this way, the key 356 ensures the wobble plate 132 rotates with the drive shaft 150. It should be noted that no surface features are shown where the ball sleeve 356 contacts the drive shaft 150. The contact between the ball sleeve 356 and the drive shaft 150 may be a friction coupling, or locking features may be provided in the ball sleeve 356 and the drive shaft 150 to ensure there is no slippage.

Referring again to FIG. 3A, a housing 360 may be provided to enclose the rotating portion of the pump 100. The housing 360 may be attached to a drive 362 that drives the drive shaft 150. The drive 362 can be a motor or an engine. The housing 360 may be attached to the drive 362 by a mounting plate 364. The drive 362 and mounting plate 364 are shown schematically, and not in cross-section, for simplicity. The housing has a proximate end 366 attached to the mounting plate 364 and a distal end 368 opposite the proximate end 366. The drive shaft 150 passes through a first opening 370 in the proximate end 366 of the housing 360 and a second opening 372 in the distal end 368 of the housing 360. Bearings (not shown) may be provided to smooth rotation of the drive shaft 150 in the openings 370 and 372.

The distal end 368 of the housing 360 may take the place of the first plate member 134. Use of a housing 360 to provide the function of the first plate member 134 may provide the additional benefit, in some cases, of compensating for axial and shear stresses caused by the motion of the wobble plate 132 and displacement rods 120. The housing 360 stabilizes the distal end 368, which in turn, along with the second plate member 136, can stabilize the displacement rods 120. In some embodiments, the second plate member 136 may also be attached to the external wall, or walls, of the housing 360 for additional stability. The housing 360 may be formed as an integral piece, including the external wall, the proximate end 366, and the distal end 368, or the distal end 368 may be a separate plate that is attached of the external wall of the housing 360 to form a portion of the housing 360. The second plate member 136 may also be attached to the external wall, or formed integrally with the housing 360.

Figure 3E:
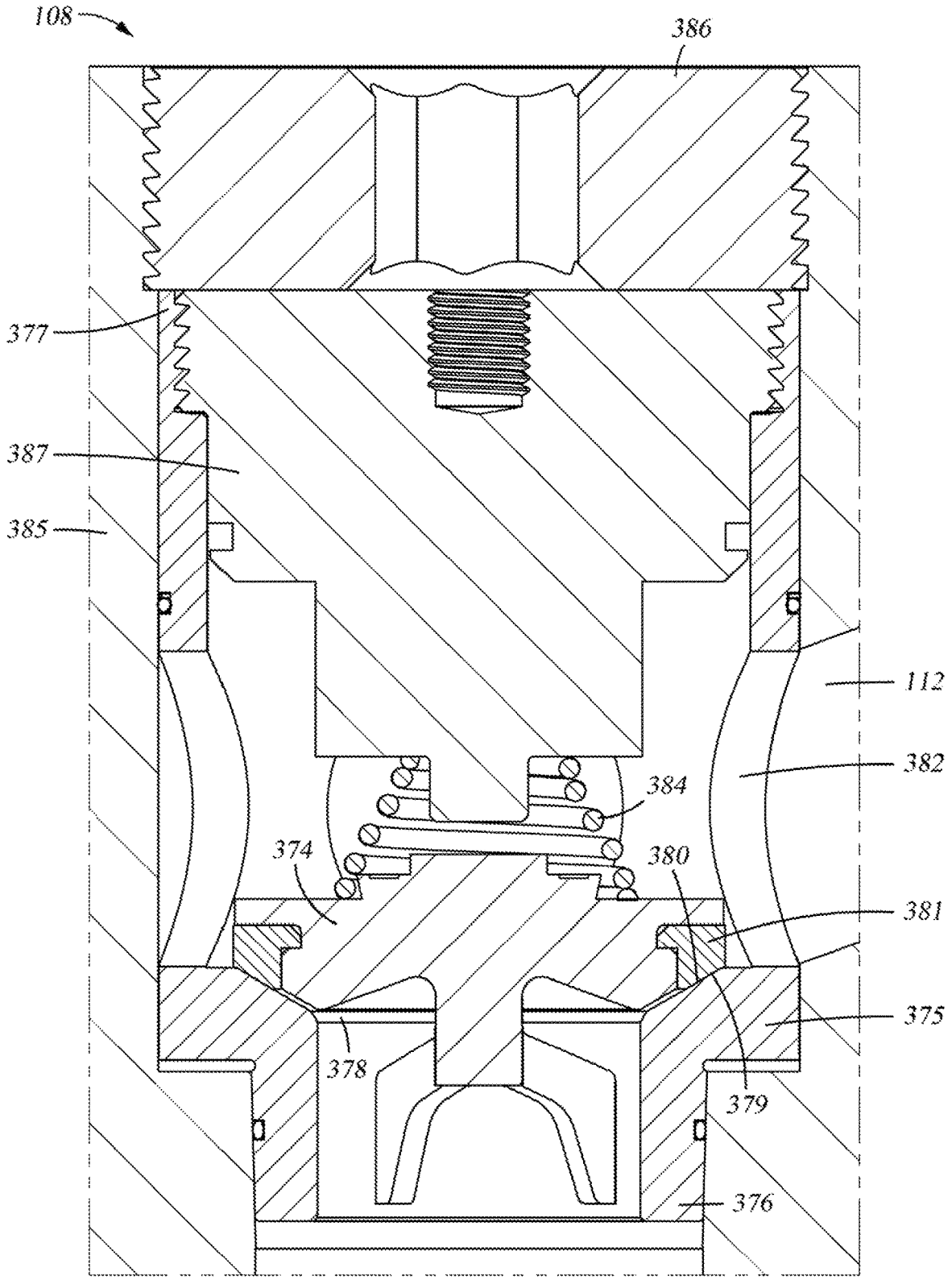
FIG. 3E is a cross-sectional view of a discharge valve cartridge for the pump of FIG. 3A.

FIG. 3E is a cross-sectional close up view of a discharge valve cartridge 108 according to one embodiment. The discharge valve cartridge 108 includes a valve body 374 disposed in a discharge cartridge body 375. The discharge cartridge body 375 has a first end 376 and a second end 377 opposite the first end. A valve seat 378 is formed at the first end 376 and comprises a conical surface 379 that engages with a sealing surface 380 of the valve body 374. The valve body 374 has a sealing ring 381 disposed around a circumference of the valve body 374 to enhance sealing between the valve body 374 and the valve seat 378. The valve body 374 is generally made of a structurally strong material such as any kind of metal appropriate for particular usage, while the sealing ring 381 may be a compliant material such as a polymer, for example polyurethane.

The discharge cartridge body 375 features a discharge opening 382 in a sidewall 383 of the cartridge body. The discharge opening 382 provides fluid coupling to the discharge coupling 112 (FIG. 3A). A valve retainer 387 is threaded into the second end 377 of the cartridge body 375, and a retention member 384, for example a spring, is disposed between the valve retainer 387 and the valve body 374 to bias the valve body 374 against the valve seat 378. The discharge valve cartridge 108 is thus assembled by removing the valve retainer 387, placing the valve body 374 into the discharge cartridge body 375 against the valve seat 378, placing the retention member 384 on the valve body 374, and then engaging the valve retainer 387. The discharge valve cartridge 108 is then ready to install in a pump. The discharge valve cartridge 108 is installed by placing the discharge valve cartridge 108 into a housing 385, which may be part of the fluid end module of the pump. The discharge valve cartridge 108 seats into the housing 385, and contacts a surface of the housing 385 at the first end 376, and along the sides of the discharge cartridge body 375. The discharge valve cartridge 108 is rotated to align the discharge opening 382 with the discharge coupling 112, and then a discharge cap 386 is threaded into the housing 385 to secure the discharge valve cartridge 108 in the housing 385. In this way, discharge valves can be easily swapped by removing the discharge cap 386 and replacing the discharge valve cartridge 108.

Figure 3F:
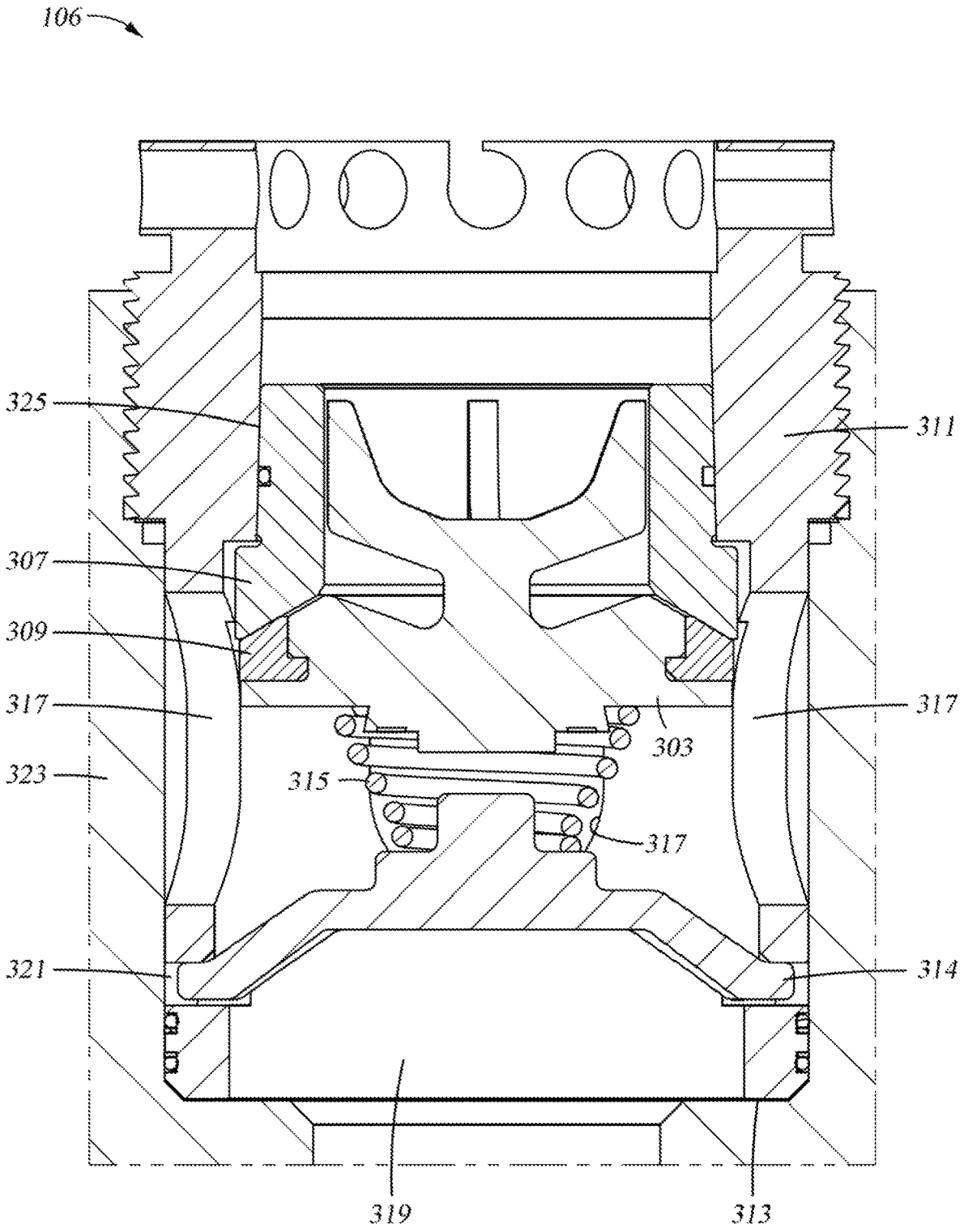
FIG. 3F is a cross-sectional view of a suction valve cartridge for the pump of FIG. 3A.

FIG. 3F is a cross-sectional close up view of the suction valve cartridge 106 shown in FIG. 3A. The suction valve cartridge 106 similarly includes a valve body 303 that seats against a similar valve seat 307. The valve body 303 likewise includes a sealing rim 309 similar to the valve body 374 of the discharge valve cartridge 108. A suction cartridge body 311 similar to the discharge cartridge body 375 includes a valve retainer 314 at a first end 313 of the suction cartridge body 311 and a similar retention member 315 between the valve body 303 and the valve retainer 314. The suction cartridge body 311 may include openings 317 to reduce the mass of the suction cartridge body 311, but since flow through the suction valve cartridge 106 is axial, the openings 317 are not needed to provide a flow pathway.

To assemble the suction valve cartridge 106, the valve body 303 is inserted into the suction cartridge body 311 through an opening 319 at the first end 313 thereof. The opening 319 also provides a flow pathway through the suction valve cartridge 106. The valve body 303 is placed against the valve seat 307. The retention member 315 is then placed on the valve body 303. Finally, the valve retainer 314 is inserted into slots 321 formed in the suction cartridge body 311. To insert the valve retainer 314, the retention member 315 is compressed toward the valve body 303. The suction valve cartridge 106 is threaded into a housing 323 for operation.

It should be noted that the suction valve cartridge 106 of FIG. 3F has a valve seat member 325 that is a separate member from the rest of the suction valve cartridge 106. The valve seat member 325 is assembled into the suction valve cartridge 106 the same way as the valve body 303. Using a valve seat member that is a separate piece allows for easy replacement of the valve seat member as the valve seat member wears, without having to replace the entire suction cartridge body 311. In alternate embodiments, the valve seat 307 can be part of the suction cartridge body 311.

Figure 4:
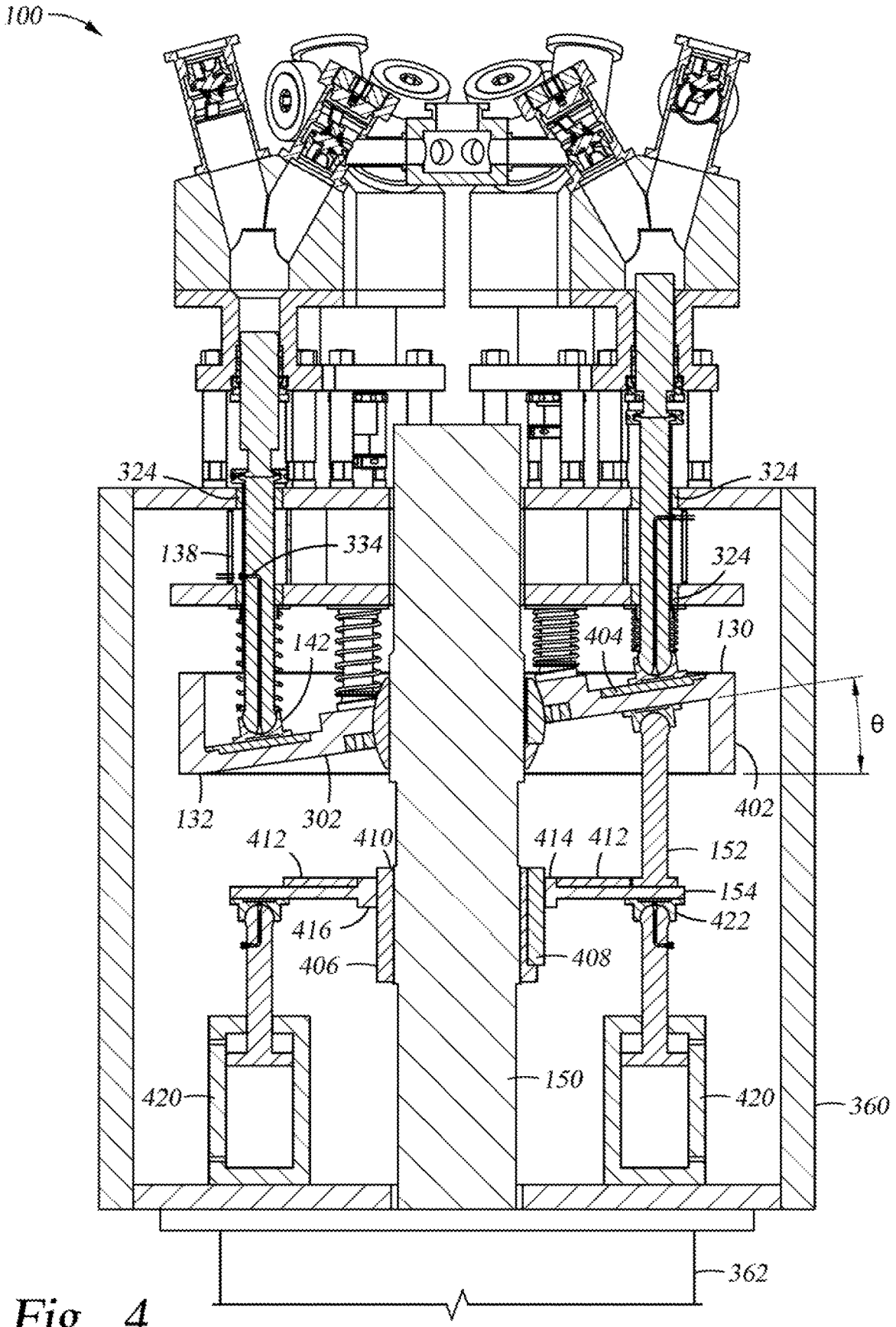
FIG. 4 is a cross-sectional view of the pump of FIG. 1 in another configuration.

FIG. 4 is a cross-sectional view of the pump 100 of FIG. 1 in another configuration. In the configuration of FIG. 4, the drive shaft 150 has rotated the wobble plate 132 for 180 degrees relative to the configuration of FIG. 3A. The tilt disk 154 and thruster rod 152 have also rotated with the drive shaft for 180 degrees. As noted above, rotating the tilt disk 154 with the drive shaft 150 and the wobble plate 132 maintains the thruster rod 152 in alignment with the power stroke of the pump 100, which maintains the tilt angle of the wobble plate 132. Because the wobble plate 132 has rotated 180 degrees, the displacement rod 120 that was formerly in maximum displacement position is now in maximum suction position, and vice versa, and the module assemblies have similarly switched.

As the displacement rods 120 reciprocate, the lubricant ports 334 move between the first plate member 134 and the second plate member 136. The spacers 138 are tubular and fit around the displacement rods 120. The spacers 138 maintain separation between the first plate member 134 and the second plate member 136 so that the lubricant ports 334 do not contact the bushings 324 in either the first plate member 134 or the second plate member 136. The spacers 138 each have a slit 160 (see FIG. 1) that provides access to the lubricant ports 334 through the wall of the spacer 138. In some embodiments the lubricant ports 334 extend through the slits 160 and outside the spacers 138, while in other embodiments the lubricant ports 334 remain inside the spacers 138 but are accessible through the slits 160.

The wobble plate 132 may have a webbing 402 to increase strength and/or stiffness and improve dynamic balance. A wear plate 404 may be used at the contact surface between the thrust bearings 142 and the first surface 130 of the wobble plate 132. It is notable from comparing FIG. 4 with FIG. 3A that the thrust bearings 142 rotate with the wobble plate 132 as the contact angle between the thrust bearings 142 and the first surface 130 changes. The thrust bearing 306, however, does not rotate because the tilt disk 154 is synchronized with the wobble plate 132, so the contact angle of the thrust bearing 306 with the second surface 302 does not change as the wobble plate 132 rotates.

The tilt disk 154 is attached to the drive shaft 150 by a guide sleeve 406 and key 408. The guide sleeve 406 is attached to the drive shaft by any convenient means, and includes a slot 410 oriented along the pump axis 104 into which the key fits. A gusset 412 may be used with the tilt disk 154 to strengthen and/or stiffen the disc. The gusset 412 extends from a hub 414 of the tilt disk 154 toward a periphery of the tilt disk 154. The hub 414 has an increased thickness relative to the rest of the tilt disk 154 to provide engagement with the key 408. A slot 416 in the hub aligns with the slot 410 in the guide sleeve 406 to provide secure locking of the tilt disk 154 to the guide sleeve 406 when the key 408 is in place. The gusset 412 may be a rib extending from the hub 414 outward (see FIG. 1), or the gusset 412 may be a plate overlying the tilt disk 154. The gusset 412 may be attached to the tilt disk 154 by any convenient means, such as welding, or the gusset 412 may be formed as an integral part of the tilt disk 154. The gusset 412 extends from the hub 414 to the thruster rod 152. Together, the tilt disk 154, the thruster rod 152, and the gusset 412 can form a tilt disk assembly, which may be attached or assembled together in any convenient way.

The guide sleeve 406 and key 408 that attaches the tilt disk 154 to the drive shaft 150 allows the drive shaft 150 to turn the tilt disk 154 while simultaneously allowing the tilt disk 154 to move axially along the drive shaft 150 while the drive shaft 150 is turning. A pair, or any convenient number, of hydraulic thrusters 420 is positioned behind the tilt disk 154 to position the tilt disk 154. The hydraulic thrusters 420 do not rotate, so contact between the hydraulic thrusters 420 and the tilt disk 154 is mediated by thrust bearings 422, which have similar features to those of the thrust bearings 142 regarding lubrication. In operation, hydraulic pressure may be applied to the hydraulic thrusters 420 to advance the tilt disk 154 while the drive shaft 150 turns the tilt disk 154 and wobble plate 132, thus increasing the tilt angle of the wobble plate 132, the stroke of the displacement rods 120 and plungers 116, and therefore the discharge pressure of the pump 100. Likewise, hydraulic pressure can be applied to the hydraulic thrusters 420 to retract the tilt disk 154 while the drive shaft 150 turns the tile disc 154 and wobble plate 132, thus decreasing the tilt angle of the wobble plate 132, the stroke of the displacement rods 120 and plungers 116, and therefore the discharge pressure of the pump 100. The pump 100 may, in fact, be idled by reducing the wobble plate 132 tilt angle to zero, all while the drive shaft 150 continues to turn.

The hydraulic pressure applied to the hydraulic thrusters 420 can be automatically adjusted based on the actual pump discharge pressure to maintain a given constant pressure output. Any over-pressure deviation will automatically pull back the tilt disk, reduce the wobble plate tilting angle, decrease the pump stroke and flow rate, and the pressure output will come down to the specified value; Any under-pressure deviation will automatically push forward the tilt disk, increase the wobble plate tilting angle, increase the pump stroke and flow rate, and the pressure output will come up to the specified value. In this way, the hydraulic thrusters 420 provide inherent output pressure control for the pump 100 in FIG. 4, by providing a hydraulic cushion to absorb at least some variation in fluid pressure at the pump discharge.

Figure 5:
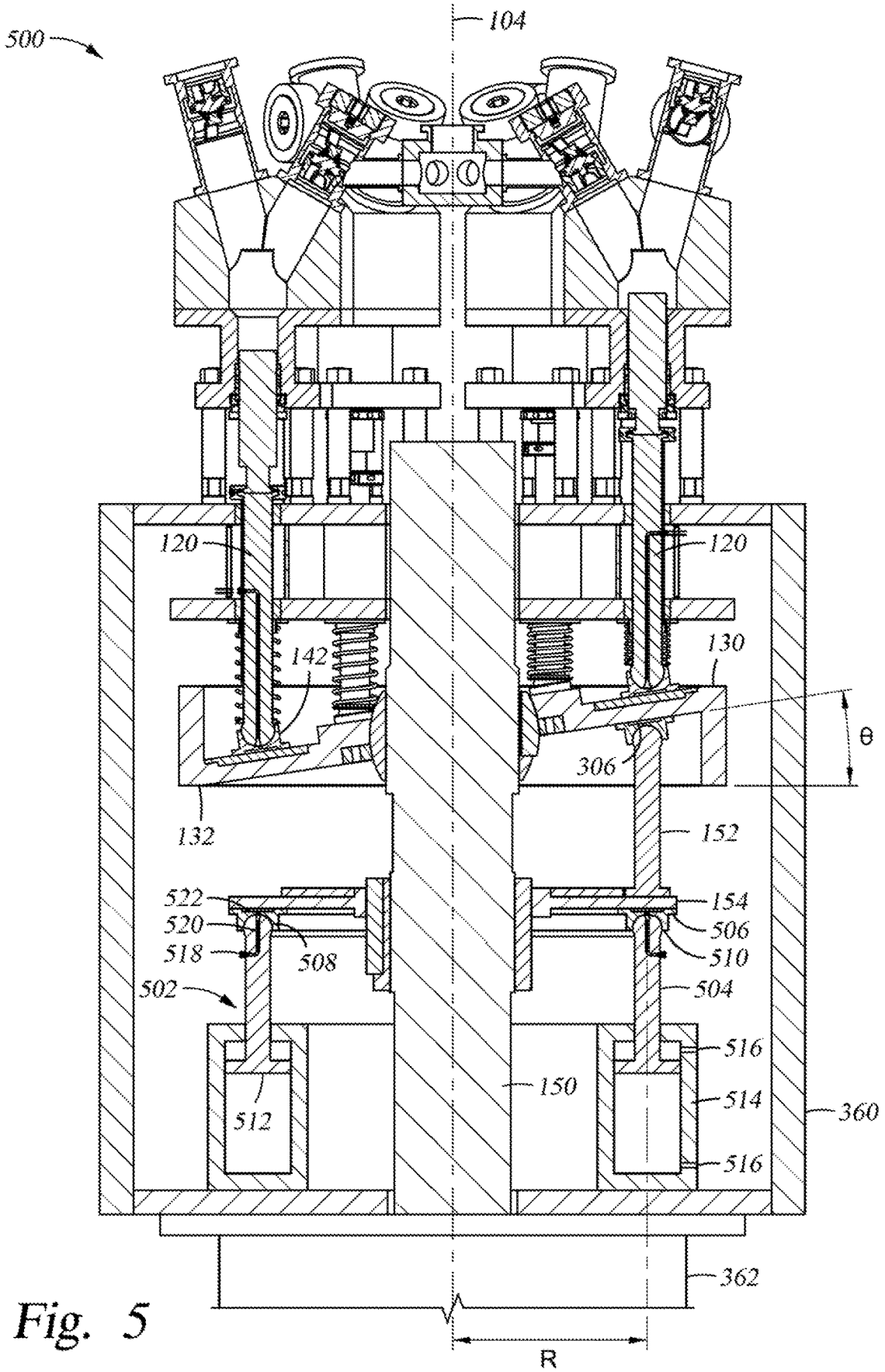
FIG. 5 is a cross-sectional view of a variable stroke pump according to another embodiment.

FIG. 5 is a cross-sectional view of a pump 500 according to another embodiment. The pump 500 differs from the pump 100 only by the mechanism of actuating the tilt disk 154. The pump 500 of FIG. 5 is shown in a different wobble plate tilt configuration from the pump 100 of FIGS. 1-4. In FIG. 5, the wobble plate 132 is in a state of reduced tilt angle. The tilt disk 154 is retracted by an amount that allows the first surface 130 to move to a different angle θ relative to a plane perpendicular to the pump axis 104. The thruster rod 152 and the displacement rods 120 (i.e., a central axis of each) are located a radius R from the pump axis 104. As the tilt angle θ of the wobble plate 132 changes, the contact point of the thrust bearings 142 and 306 changes on the first and second surfaces 130 and 302, respectively. The pivoted thrust bearings 142 and 306 enable the wobble plate 132 to slide between the thruster rod 152 and the displacement rods 120 as the tilt angle θ changes.

The pump 500 of FIG. 5 has a cylindrical hydraulic actuator 502 for moving the tilt disk 154. A cylindrical thruster 504 contacts the tilt disk 154 at an annular contact surface 506. A first end 510 of the cylindrical thruster 504 is fitted with a slip ring 508 that mediates the contact with the tilt disk 154. The slip ring 508 may be similar to one of the thrust bearings 422 in cross-section and generally describes an annulus that rides between the first end 510 of the cylindrical thruster 504 and the tilt disk 154. A second end 512 of the cylindrical thruster 504 is housed in a cylindrical hydraulic chamber 514. One or more hydraulic fluid ports 516 may be provided for advancing and retracting the cylindrical thruster 504 in the cylindrical hydraulic chamber 514. As shown in FIG. 5, the drive shaft 150 extends through the cylindrical hydraulic actuator 502 to reach the drive. One or more lubricant ports 518 may be provided in the cylindrical thruster 504 for lubricating the slip ring 508, which has an annular groove 522 that distributes a lubricant between the slip ring 508 and the tilt disk 154. The slip ring 508 has at least one port 510 aligned with at least one of the lubricant ports 518 for admitting lubricant from the lubricant port 518 to the annular groove 522. There may be multiple ports 510 distributed evenly or unevenly around the slip ring 508, or the port 510 may be a continuous or discontinuous groove around part or all of the slip ring 508.

Figure 6:
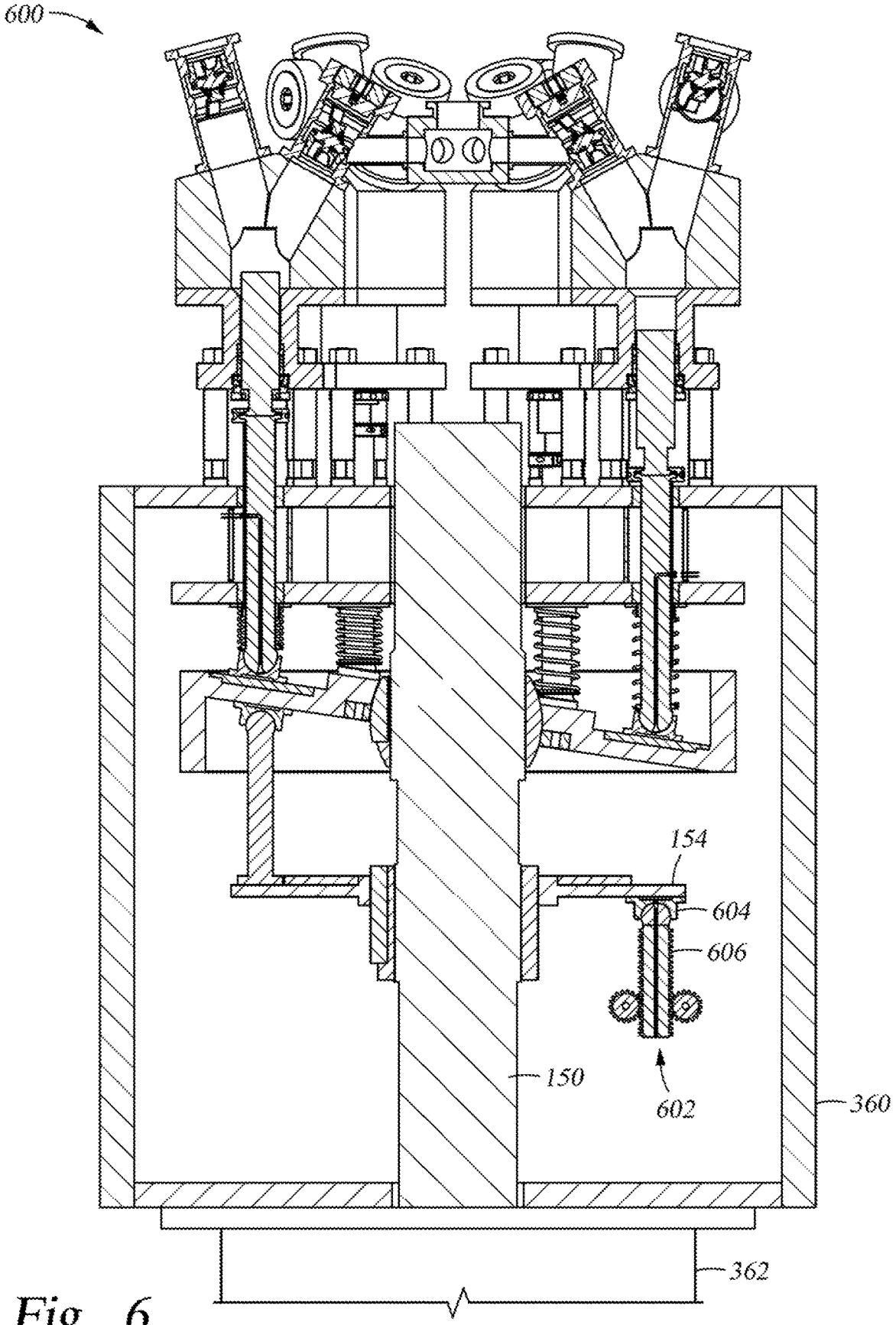
FIG. 6 is a cross-sectional view of a variable stroke pump according to another embodiment.

FIG. 6 is a cross-sectional view of a pump 600 according to another embodiment. The pump 600 differs from the pumps 100 and 500 in the manner of actuating the tilt disk 154. The pump 600 has, at least, a rack and pinion actuator 602 fitted with a thrust bearing 604 on an end of the rack 606. Although not shown, the thrust bearing 604 may include lubrication features as described elsewhere for other thrust bearings. It should be noted, that the rack and pinion 602 may also be combined with a cylindrical thruster similar to the cylindrical thruster 504 of FIG. 5.

Figure 7:
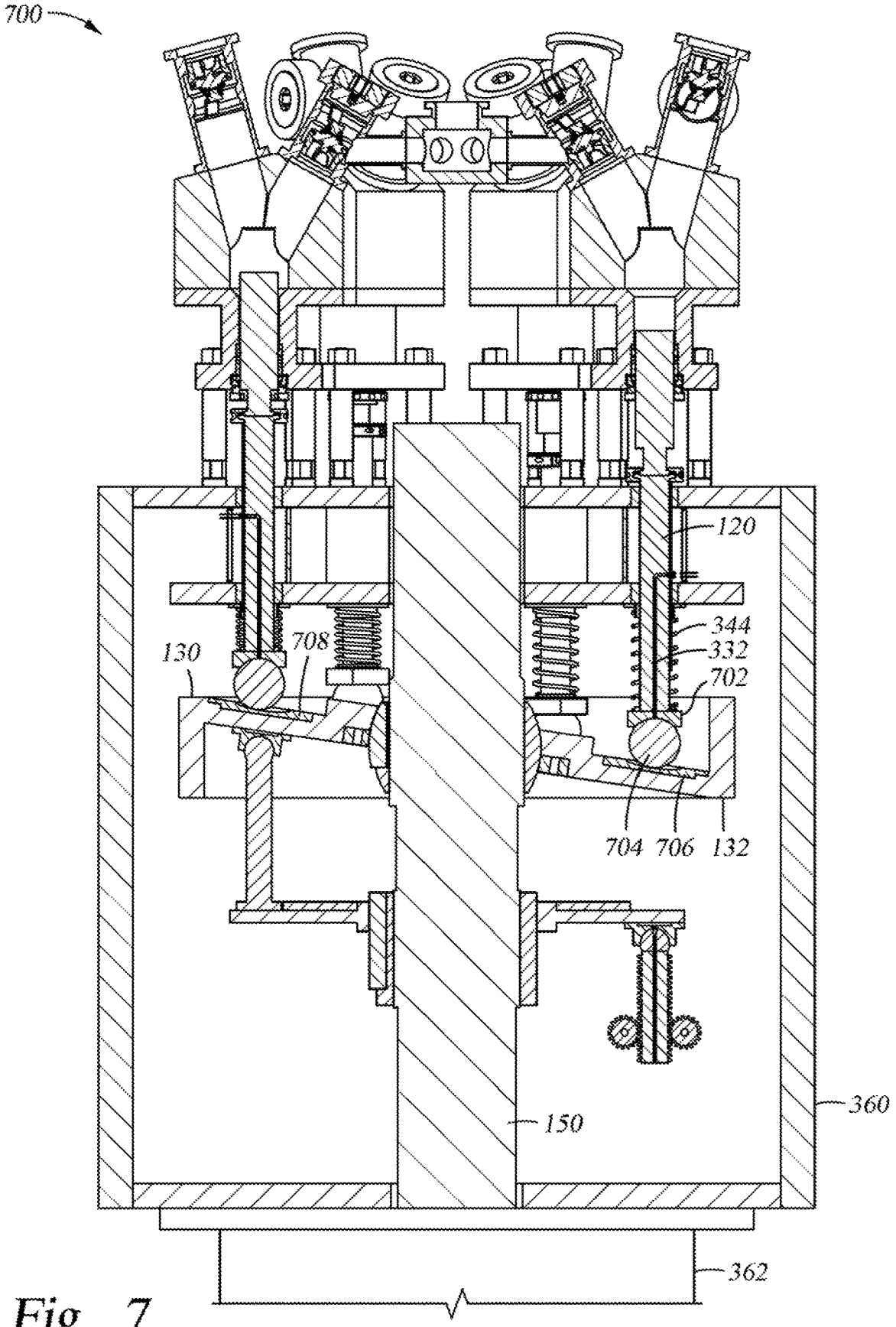
FIG. 7 is a cross-sectional view of a variable stroke pump according to another embodiment.

FIG. 7 is a cross-sectional view of a pump 700 according to another embodiment. The pump 700 includes the rack-pinion actuator like the pump 600, but differs from the pumps 100, 500, and 600 in the coupling of the wobble plate 132 to the displacement rods 120. Instead of the thrust bearings 142, the pump 700 couples the wobble plate 132 to the displacement rods 120 using bearings 704. One bearing 704 is provided for each displacement rod 120 to provide a rolling coupling between the rotating wobble plate 132 and the non-rotating displacement rods 120. Each displacement rod 120 in the pump 700, has a bearing cup 702 that couples the displacement rod 120 to the bearing 704. Each bearing 704 contacts the wobble plate 132 in a race 706 circumscribing the drive shaft 150 along the first surface 130 of the wobble plate 132 at a convenient radius. The race 706 may be formed directly in the first surface 130 of the wobble plate 132, or may be provided in a wear plate 708, which is similar to the wear plate 404 except for the function of accommodating the bearing race 706. Lubricant may be provided to the bearings 704 using the lubrication system described above, or by any other convenient means.

Figure 8:
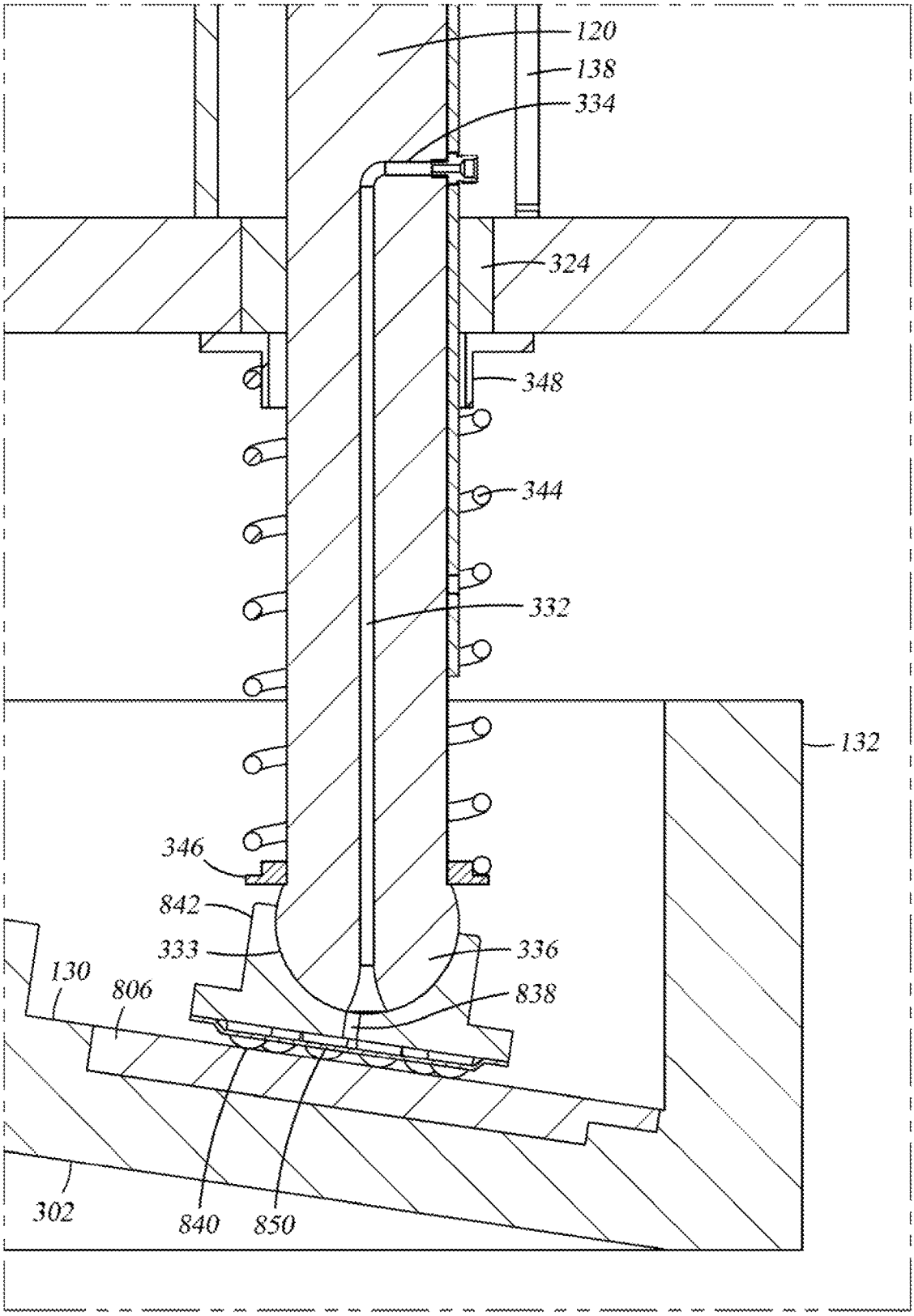
FIG. 8 is a detailed view of a bearing coupling for a variable stroke pump according to another embodiment.

FIG. 8 is a detailed view of a bearing coupling according to another embodiment. Rather than a single bearing for each displacement rod 120, as in FIG. 7, the embodiment of FIG. 8 features a bearing assembly comprising a bearing shoe 842 coupled to the rounded tip 333 of the displacement rod 120 and a plurality of bearings 840 disposed in a surface of the bearing shoe 842 facing the wobble plate 132. A wear plate 806 is disposed in the first surface 130 of the wobble plate 132 to provide a rolling contact surface for the bearings 840. A bearing retainer plate 850 is attached to the bearing shoe 842 at the surface facing the wobble plate 132 to hold the bearings 840 in place. As with the thrust bearings in other embodiments and figures herein, the bearing shoe 842 has a passage 838 for flowing lubricant from the lubricant passage 332 to the bearings 840 between the bearing shoe 842 and the wear plate 806. Each displacement rod 120 may be provided with a bearing assembly such as that shown in FIG. 8.

In other embodiments, the rotational decoupling described above may be accomplished, for example using a wear plate such as the wear plate 404, by inserting bearings between the wear plate 404 and the first surface 130 of the wobble plate 132. In such embodiments, the wear plate 404 can be decoupled from the rotation of the wobble plate 132, and may even be hinged directly to the displacement rods 120. In such an embodiment, a bearing race would be formed in the first surface 130 and in a facing surface of the wear plate 404 to accommodate the bearings, which would be continuously distributed around the wobble plate 132 in the space between the first surface 130 and the wear plate 404. In such embodiments, a lip may be provided extending from the wear plate toward the first surface 130 on either side of the bearing race to constrain any radial motion of the bearings. A lip may also be extended from the first surface 130 toward the wear plate.

It should be noted that, in principle, the various methods of decoupling the rotation of the wobble plate 132 from the displacement rods 120 may be mixed in a single pump. For a collection of displacement rods, a first portion may be rotationally decoupled from the wobble plate using one kind of thrust bearing, such as a slipper shoe or tilt pad, while a second portion is rotationally decoupled using a different kind of thrust bearing, for example one or more roller bearing embodiments.

For hydraulic fracturing applications, with the in-line pumps 100, 600 and 700, pump orientation on a frac truck or other frac facility is changed from a transverse mounting position to a parallel position, thus eliminating typical geometric constraints and increasing power transmission mechanical efficiency. Among other things, variable pump flow rate allows for a constant input shaft speed, thus eliminating the need for a transmission. Constant speed input and the ability to change torque requirements independent of rotational speed also allows for greater options of prime movers: diesel engine, natural gas engine, AC electric motor, DC electric motor, turbine.

Moreover, with the pump designs herein, fluid chambers can be configured in parallel or series to provide a single stage of compression or multiple compression stages. Fluid end suction and discharge can be connected in multiple configurations to alter the effect of harmonics created by a positive displacement pump. Fluid end suction and discharge ports can be connected to other piping systems by means of rigid piping or flexible piping such as a hose. Finally, the pumps described herein can pump various incompressible and compressible fluids, and even slurries comprising a percentage of solids.

The various different tilt actuator designs described herein, including the hydraulic thrusters 420, the cylindrical hydraulic actuator 502, and the rack pinion actuator 602, may be used with any design for coupling the wobble plate 132 to the displacement rods 120, including the slipper shoe design and the various bearing designs described herein. Moreover, whereas the rack pinion 602 is shown in a location opposite the location of the thruster rod 152 in FIGS. 6 and 7, the rack pinion 602 may be located in alignment with the thruster rod 152.

Figure 9A:
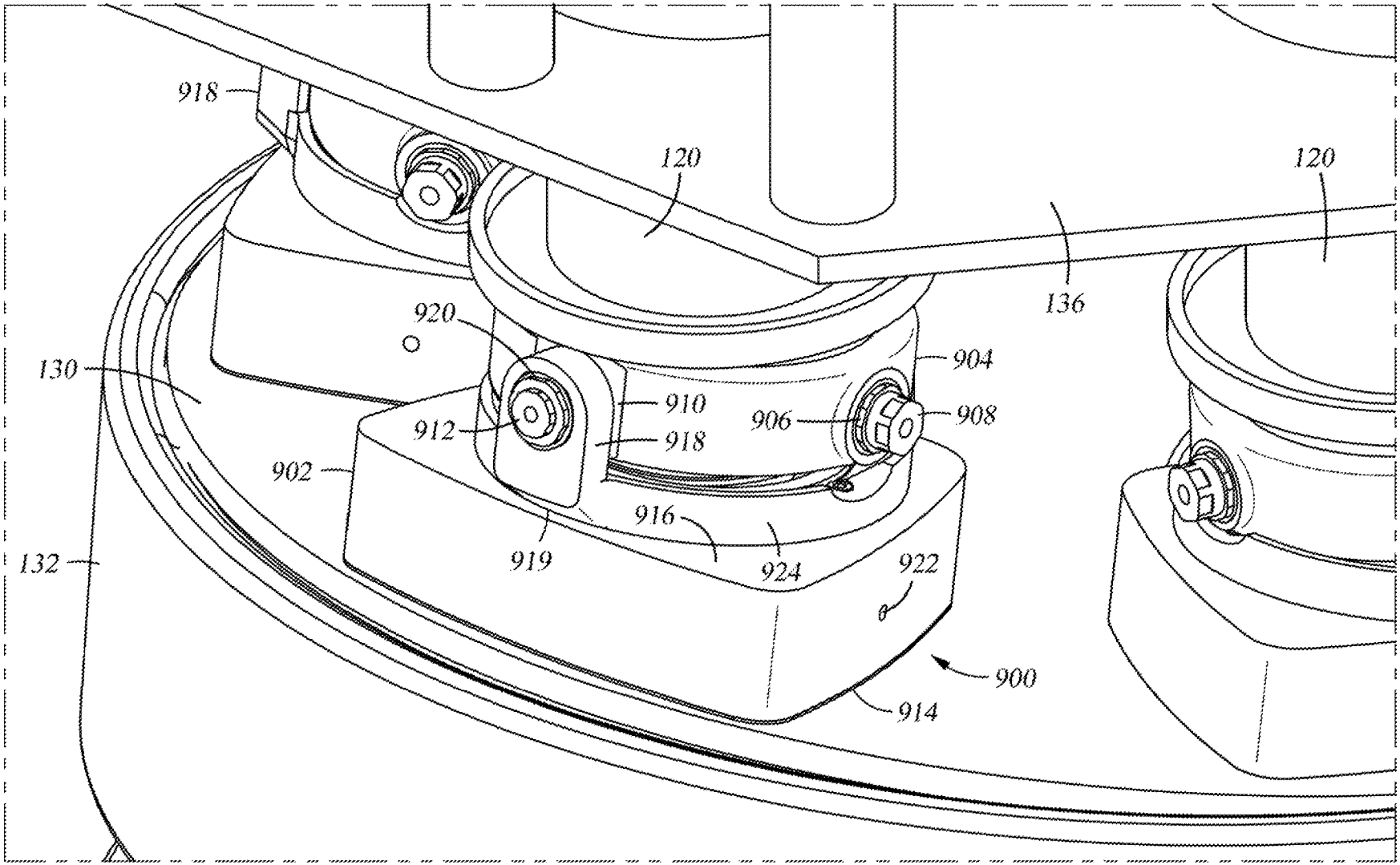
FIG. 9A is a perspective view of a bearing coupling for a variable stroke pump according to another embodiment.

FIG. 9A is a perspective view of a bearing coupling 900 for a variable stroke pump according to another embodiment. The variable stroke pump can be any of the pumps 100, 500, or 600 described herein. One of the displacement rods 120 is shown, with one other partially visible. The bearing coupling 900 provides a swivel contact bearing between the displacement rod 120 and the first surface 130 of the wobble plate 132. The bearing coupling 900 is attached to the distal end 336 (not visible in FIG. 9A) of the displacement rod 120 and contacts the first surface 130 at a slip interface.

The bearing coupling 900 includes a tilt pad 902 and a gimbal 904. The gimbal 904 allows the tilt pad 902 to swivel about the distal end of the displacement rod 120 without rotating about the axis of the displacement rod 120. The gimbal 904 is attached to the displacement rod 120 at a first rotation point 906 using first connectors 908. The tilt pad 902 is attached to the gimbal 904 at a second rotation point 910, with angular displacement from the first rotation point 906 of 90 degrees, using second connectors 912. There are four total attachment points where the gimbal 904 couples to the displacement rod 120 and the tilt pad 902. Two are visible in FIG. 9A, corresponding to the two rotation points 906 and 910. The other two attachment points are opposite the visible attachment points, and define the rotational axes of the gimbal 904.

The tilt pad 902 has a contact face 914 and a support face 916 opposite the contact face 914. A collar 924 extends from the support face 916 and surrounds the swivel coupling of the tilt pad 902 to the displacement rod 120. A strut 918 extends from the support face 916, through a notch 919 in the collar to align with the gimbal 904 so the second connector 912 can extend through an opening 920 in the strut 918, and through the gimbal 904 to fasten the strut 918, and thus the tilt pad 902, rotatably to the gimbal 904. The gimbal 904 thus rotates about the axis defined by the first rotation point 906 while the tilt pad 902 rotates about the axis defined by the second rotation point 910. There are two struts 918 on opposite sides of the tilt pad 902. Only one strut 918 is visible in FIG. 9A. In this case, the struts 918 are fixed to the support face 916 at locations that are bisected by a radius of the wobble plate 132. In other words, the two struts 918 of each bearing coupling 900 are aligned along a radius of the wobble plate 132. In other embodiments, the two struts 918 may be at locations that are not aligned along a radius of the wobble plate 132, so long as the first and second rotation points 906 and 910 remain displaced by 90 degrees.

Contact between the contact face 914 and the first surface 130 is mediated by lubricant so that the wobble plate 132 can rotate freely while the displacement rod 120 moves only along its axis. A lubricant port 922 is provided in a surface of the tilt pad 902 to flow lubricant through the tilt pad 902 to the contact face 914. Here the lubricant port 922 is located in a side surface of the tilt pad 902, but the port may be located in any surface of the tilt pad 902 except for the contact face 914. The lubricant system for the tilt pad 902 will be described further below.

Figure 9B:
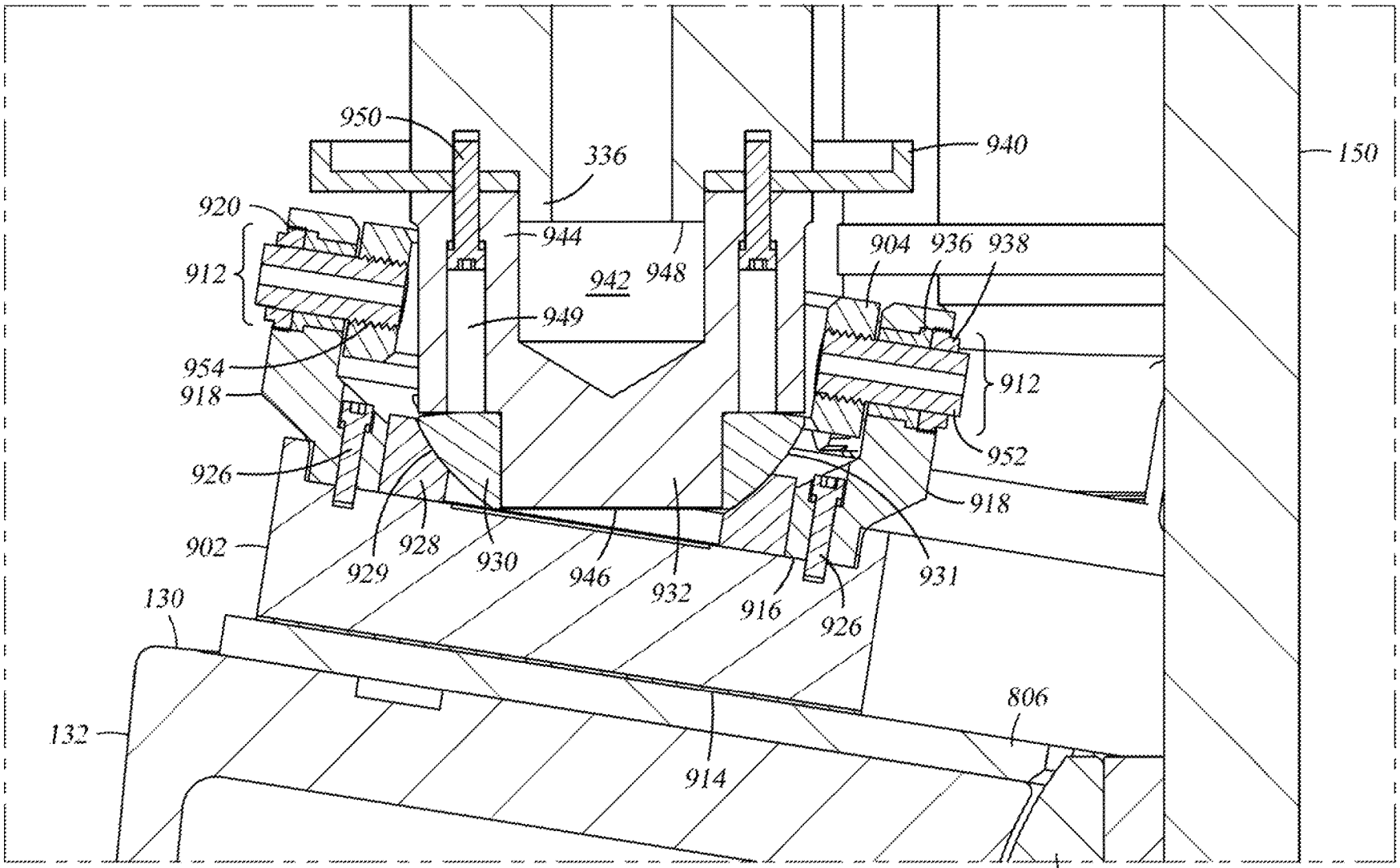
FIG. 9B is a cross-sectional view of the bearing coupling of FIG. 9A.

FIG. 9B is a cross-sectional view of the bearing coupling 900 of FIG. 9A. The section is taken through the struts 918, so both struts 918 and both of the second connectors 912 are visible. The struts 918 extend from the support face 916 of the tilt pad 902 and are fixed thereto by fasteners 926. The struts 918 abut a swivel ring 928 disposed against the support face 916 just inside the inner edges of the struts 918. The swivel ring 928 has a swivel surface 929 that faces upward and inward to provide a contact surface between the bearing coupling 900, which swivels about two axes, and the displacement rod 120. The swivel surface 929 is concave and spherical. A cap ring 930 is coupled to the distal end 336 of the displacement rod 120 to contact the swivel surface 929 of the swivel ring 928. The cap ring 930 has a convex spherical contact surface 931 to contact the concave swivel surface 929. The curvature of the contact surface 931 matches the curvature of the swivel surface 929 to provide smooth sliding contact between the two surfaces.

The cap ring 930 is press fit onto an end connector 932, which connects the cap ring 930 to the displacement rod 120. The end connector 932 is a generally cylindrical member with a first end 944 and a second end 946. A bore 942 is formed in the first end 944 so that the end connector 932 can fit over a nose 948 of the displacement rod 120 extending from the distal end 336 thereof. The nose 948 is a cylindrical extension from the distal end 336 that has a diameter smaller than the diameter of the displacement rod 120. The end connector 932 fits onto the nose 948 so that the first end 944 of the connector contacts the distal end 336 of the displacement rod 120 on the side of the nose 948. The end connector 932 is fixed to the distal end 336 of the displacement rod 120 by fasteners 950 disposed in two or more bores 949 formed from near the first end 944 to the second end 946 of the end connector 932.

The connectors 912 support rotation of the tilt pad 902 about an axis defined by the connectors 912 through the openings 920 in the struts 918. Each connector 912 comprises a connection member 952, a sleeve 936, and a retainer 938. The connection member 952 extends through the opening 920 in the strut 918 and into a connection recess 954 formed in the gimbal 904. In this case, the connection recess 954 and the connection member 952 are both threaded. The sleeve 936 is press-fit into the opening 920 through the strut 918 and surrounds the connection member 952. The sleeve 936 is held in place in the opening 920 by the retainer 938. The retainer 938 fits into the opening 920 around the connection member 952 and fastens into the opening 920 of the strut 918. In this case the retainer 938 is threaded. The sleeve 936 thus functions as a swivel bearing for the tilt pad 902, rotating about the connection member 952.

The connectors 912 also prevent over-rotation of the tilt pad 902. Other means, such as traditional stoppers, can be used in addition or instead, to restrain rotation of the tilt pad 902.

The embodiment shown in FIGS. 9A and 9B includes a spring retention ring 940 that has function similar to the ledge 346 of FIG. 8. The spring retention ring 940 fits between a portion of the first end 944 of the connector 932 and the distal end 336 of the displacement rod 120. The fasteners 950 extend through the spring retention ring 940 into the distal end 336 of the displacement rod 120. The spring retention ring 940 has a radius greater than the displacement rod 120 to provide a ledge for supporting one of the springs 344 of FIG. 3B.

Figure 9C:
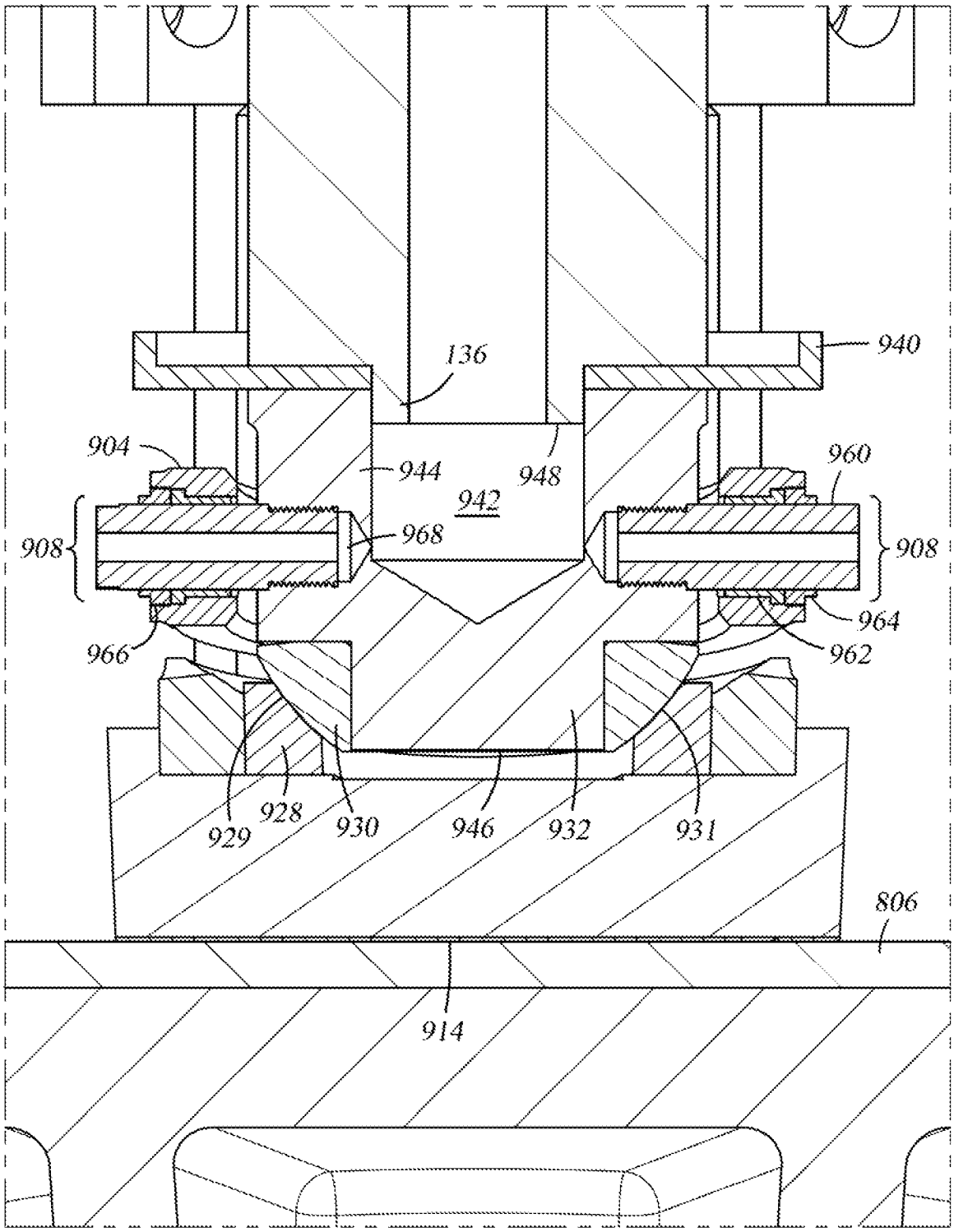
FIG. 9C is a cross-sectional view of the bearing coupling of FIG. 9A taken along a different section line from FIG. 9B.

FIG. 9C is a cross-sectional view of the bearing coupling 900 taken along a different section orthogonal to the section of FIG. 9B. In the view of FIG. 9C, the connectors 908 are visible coupling the gimbal 904 to the displacement rod 120. Here, the coupling of the tilt pad 902 to the gimbal 904 (FIG. 9B) is not visible. Similar to the connectors 912, each connector 908 includes a connection member 960, a sleeve 962, and a retainer 964. In this case, the connection members 960 extend through an opening 966 in the gimbal 904 and into a threaded bore 968 in the end connector 932. The gimbal 904 is thus rotatably fastened to the end connector 932 and rotates about the axis defined by the connectors 908. In this manner, two axes of rotation are provided for the tilt pad 902 relative to the displacement rod 120.

Figure 9D:
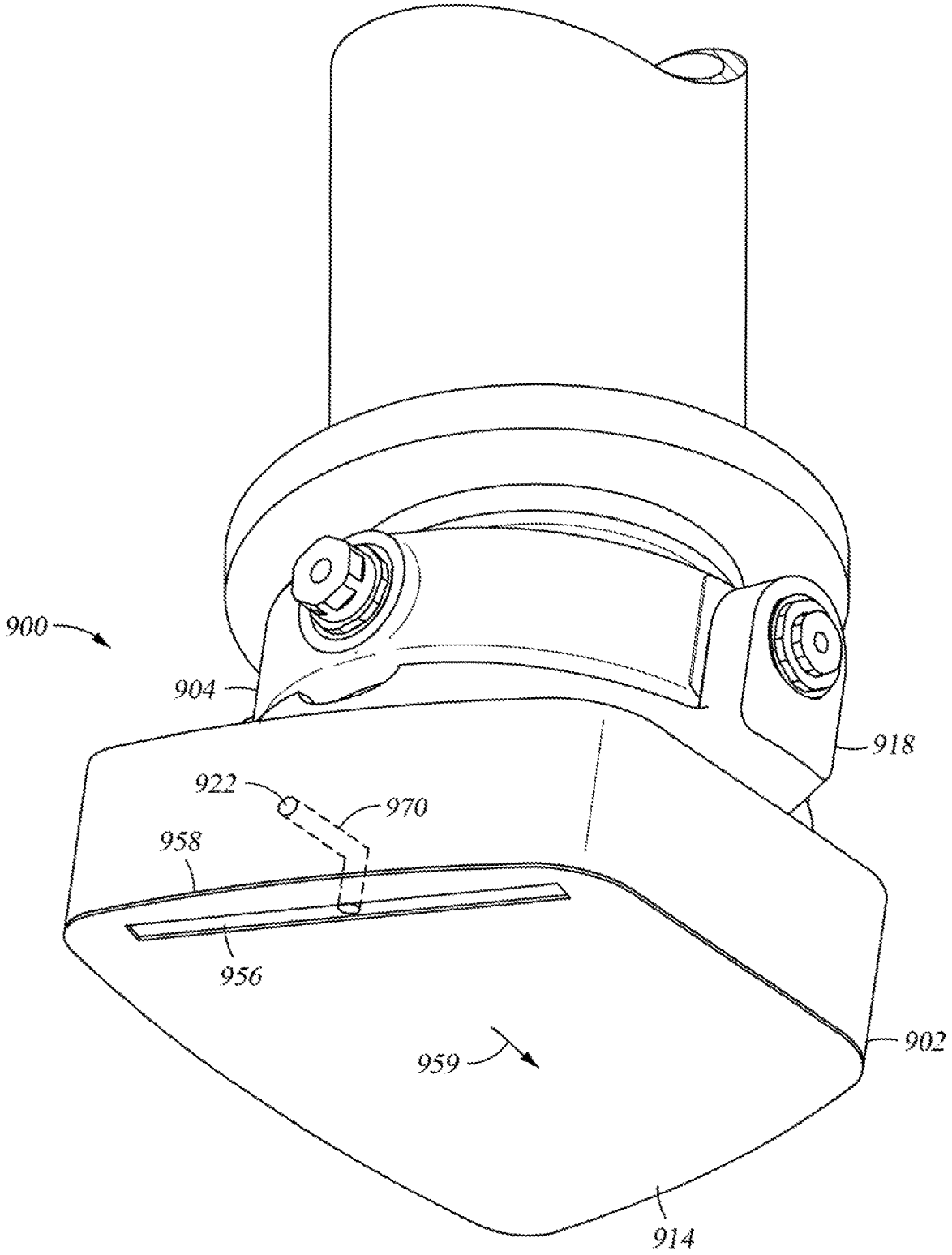
FIG. 9D is a bottom view of the bearing coupling of FIG. 9A.

FIG. 9D is a bottom view of the bearing coupling 900. This view shows the contact face 914 of the tilt pad 902. A slit 956 is formed in the contact face 914 of the tilt pad 902 to deliver lubricant between the contact face 914 and the first surface 130 of the wobble plate (FIG. 9A). A lubricant pathway 970 provides fluid communication from the lubricant port 922 to the slit 956. Lubricant is pressured into the lubricant port 922, through the lubricant pathway 970, and out through the slit 956 to lubricate the interface between the contact face 914 and the first surface 130. The slit 956 is oriented generally along the direction of a radius of the wobble plate 132, although the orientation might not be exactly parallel to the radius of the wobble plate 132. The slit 956 is located along a leading edge 958 of the tilt pad 902 in the direction of rotation of the wobble plate 132, indicated by arrow 959. In other words, a given location on the wobble plate 132 that contacts (as mediated by lubricant) the tilt pad 902 first encounters the leading edge 958 of the tilt pad 902 and traverses across to the edge opposite the leading edge 958. The slit 956 is located near the leading edge 958 so that motion of the wobble plate 132 sliding past the contact face 914 will transport lubricant across the contact face 914 from the leading edge 958 to the edge opposite the leading edge 958, lubricating substantially the entire contact face 914 in the process. The tilt pad 902 is thus an example of the thrust bearing 142 of FIG. 1. Another method of lubricating the contact face 914 of the tilt pad 902 is to provide a lubricant distributor, such as a nozzle or nozzle array, on the side of the tilt pad 902 near the leading edge 958 to distribute lubricant to the contact face 914 at the leading edge 958 so that the lubricant lubricates the entire contact face 914 as the wobble plate 132 slides past the contact face 914.

Figure 10A:
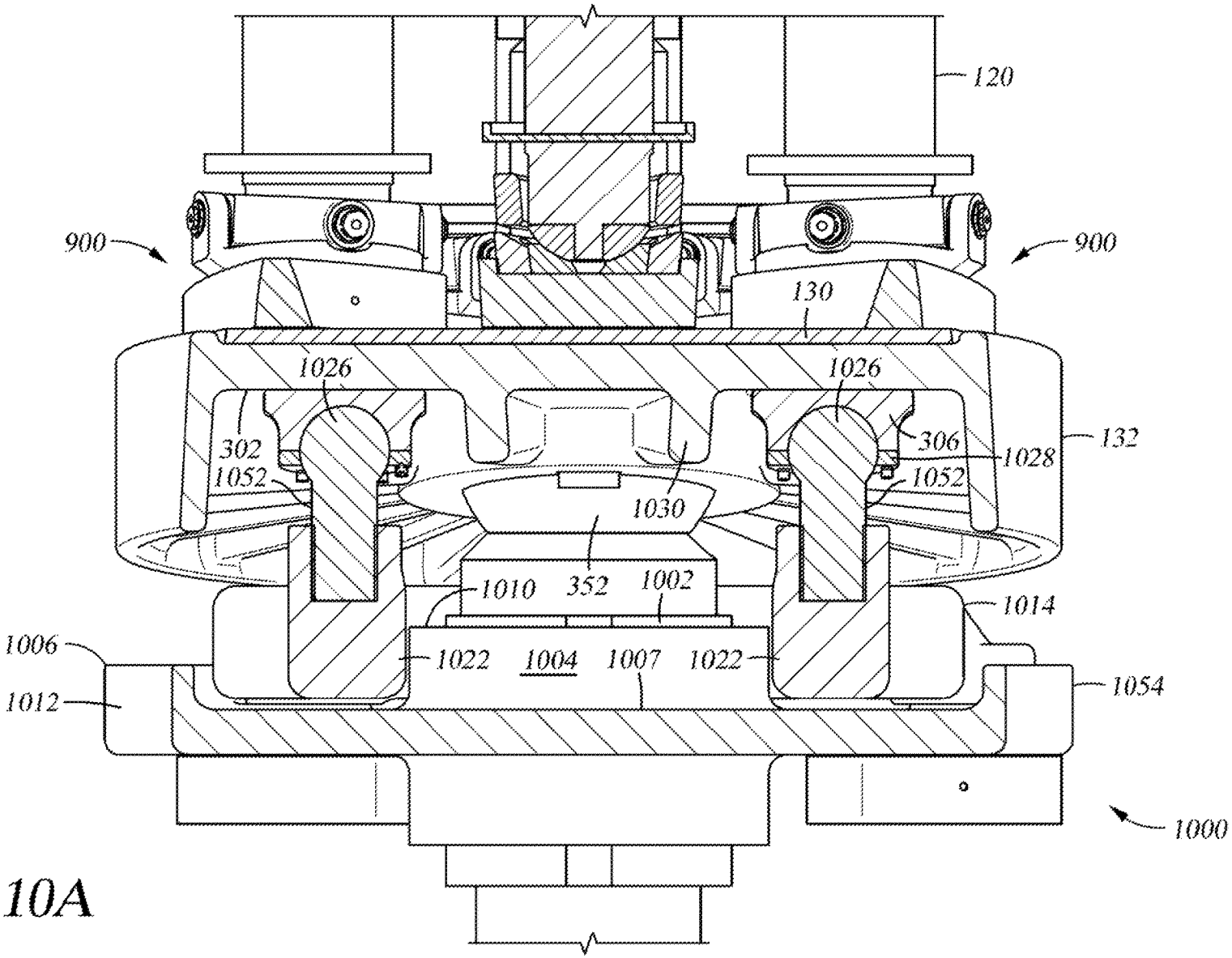
FIG. 10A is a partial cutaway view of a tilt actuator assembly according to another embodiment.
Figure 10B:
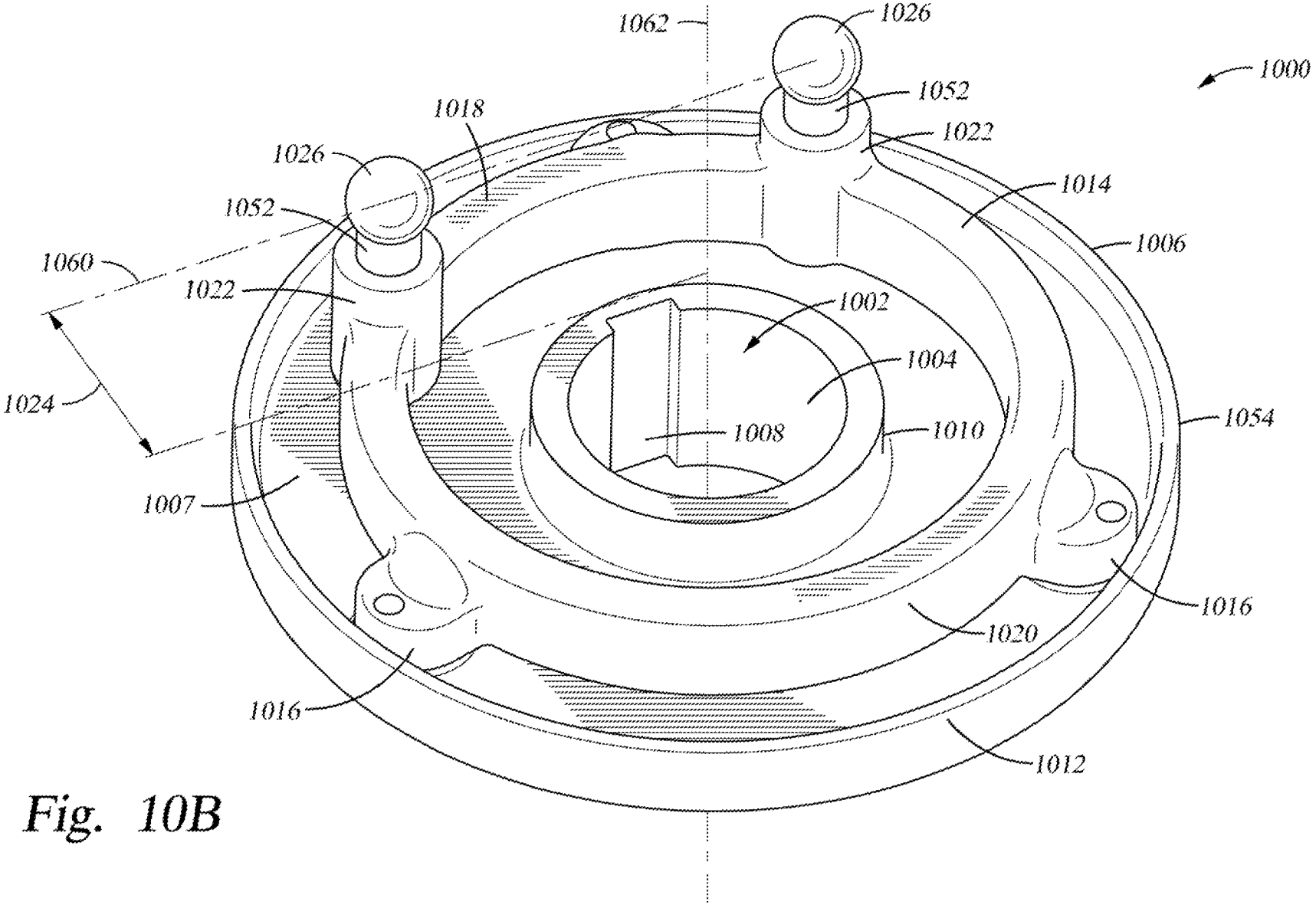
FIG. 10B is a perspective view of the tilt actuator assembly of FIG. 10A.

FIG. 10A is a partial cutaway view of a tilt actuator assembly 1000 of a variable stroke pump. FIG. 10B is a perspective view of the tilt actuator assembly 1000. The tilt actuator assembly 1000 of FIGS. 10A and 10B can be used with any of the pumps 100, 500, or 600 described herein. The tilt actuator assembly 1000 includes a tilt disk 1054, a gusset 1014, and two thruster rods 1052. The tilt disk 1054 is a plate with a central opening 1002 that defines an inner edge 1004. The tilt disk 1054 also has an outer edge 1006. The central opening 1002 accommodates the drive shaft 150 and guide sleeve 406, and the tilt disk 1054 has a slot 1008 formed in the inner edge 1004 to mesh with a ridge on the drive shaft 150 (not shown). The slot 1008 allows the drive shaft 150 to drive rotation of the tilt disk 1054. The slot 1008 can accommodate a key attachment such as the key 408 of FIG. 4. An inner lip 1010 is formed at the inner edge 1004, and an outer lip 1012 is formed at the outer edge 1006. A surface 1007 of the tilt disk 1054 between the inner and outer edges 1004 and 1006 defines a plane. The inner and outer lips 1010 and 1012 each extend away from the same side of the tilt disk 1054, and here are each perpendicular to the plane of the surface 1007 of the tilt disk 1054.

The gusset 1014 is a ring that is attached to the tilt disk 1054 at three attachment points 1016. The attachment points are at equal angular distances around the circumference of the gusset 1014. The gusset 1014 has a radius such that the gusset 1014 fits between the inner and outer lips 1010 and 1012, and a flat surface of the gusset 1014 contacts the flat surface of the tilt disk 1054 between the inner and outer lips 1010 and 1012. The attachment points 1016 are extensions that extend radially outward from the body of the gusset 1014 toward the outer lip 1012 when the gusset 1014 is affixed to the tilt disk 1054. The gusset 1014 has a first ring section 1018 and a second ring section 1020 that are joined together by two sockets 1022 to form the gusset 1014.

The two sockets 1022 are cylindrical to accommodate the cylindrical thruster rods 1052. Here, the two sockets 1022 each have a diameter that is greater than the thickness of the ring sections 1018 and 1020, which have the same thickness. The two sockets 1022 have an angular separation of about 120 degrees, making the first ring section 1018 smaller in angular extent than the second ring section 1020. One of the attachment points 1016, labelled 1016A in FIG. 10B, is located on the first ring section 1018 between the two sockets 1022. The attachment point 1016A may be located at an equal angular distance from the two sockets 1022, or, as here, the distances may be unequal. Each of the ring sections 1018 and 1020 has a truncated-arch profile, with a flat bottom, two straight sides extending from the flat bottom, and a circular side, shaved flat on top, opposite the flat bottom and connected to the two straight sides. The gusset 1014 is attached to the tilt disk 1052 at the attachment points 1016 using fasteners such as bolts or rivets. The gusset 1014 can also be welded to the tilt disk 1052.

The two thruster rods 1052 are oriented perpendicular to the plane of the surface 1007 of the tilt disk 1054, as in other embodiments described herein. The two thruster rods 1052 are positioned along a line 1060 that is displaced from a central axis 1062 of the tilt disk 1054 by a distance 1024. The distance 1024 is selected to provide torque for adjusting tilt of the wobble plate 132. Here, the distance 1024 is about half the diameter of the tilt disk 1054, but any convenient distance may be used to provide more or less torque as desired. Dimensions of the gusset 1014 can be adjusted to provide requisite strength for the tilt disk assembly 1000.

Each thruster rod 1052 has a spherical end 1026 that extends from the socket 1022 into which the thruster rod 1052 is installed. The thrust bearings 306 of FIG. 3B accommodate the spherical ends 1026 of the thruster rods 1052 against the second surface 302 of the wobble plate 132. The thrust bearings 306 move laterally against the second surface 302 as the tilt angle of the wobble plate 132 changes. Here, a retention plate 1028 is attached to each thrust bearing 306 with fasteners to retain the spherical end 1026 securely in the spherical recess of the thrust bearing 306. It should be noted in FIG. 10A that the wobble plate 132 can have radial webbing for extra stiffness, if desired. Here, the wobble plate 132 has a radial webbing 1030.

The two thruster rods 1052 are spaced apart to spread the load of maintaining tilt position of the wobble plate 132 as the entire assembly rotates. Depending on rotation direction, one of the two thruster rods 1052 will carry more mechanical load than the other. In this case, the gusset 1014 acts as a load spreader, with the three attachment points 1016 acting to distribute the axial load from the thruster rods 1052 across an area of the tilt disk 1054.

Figure 10C:
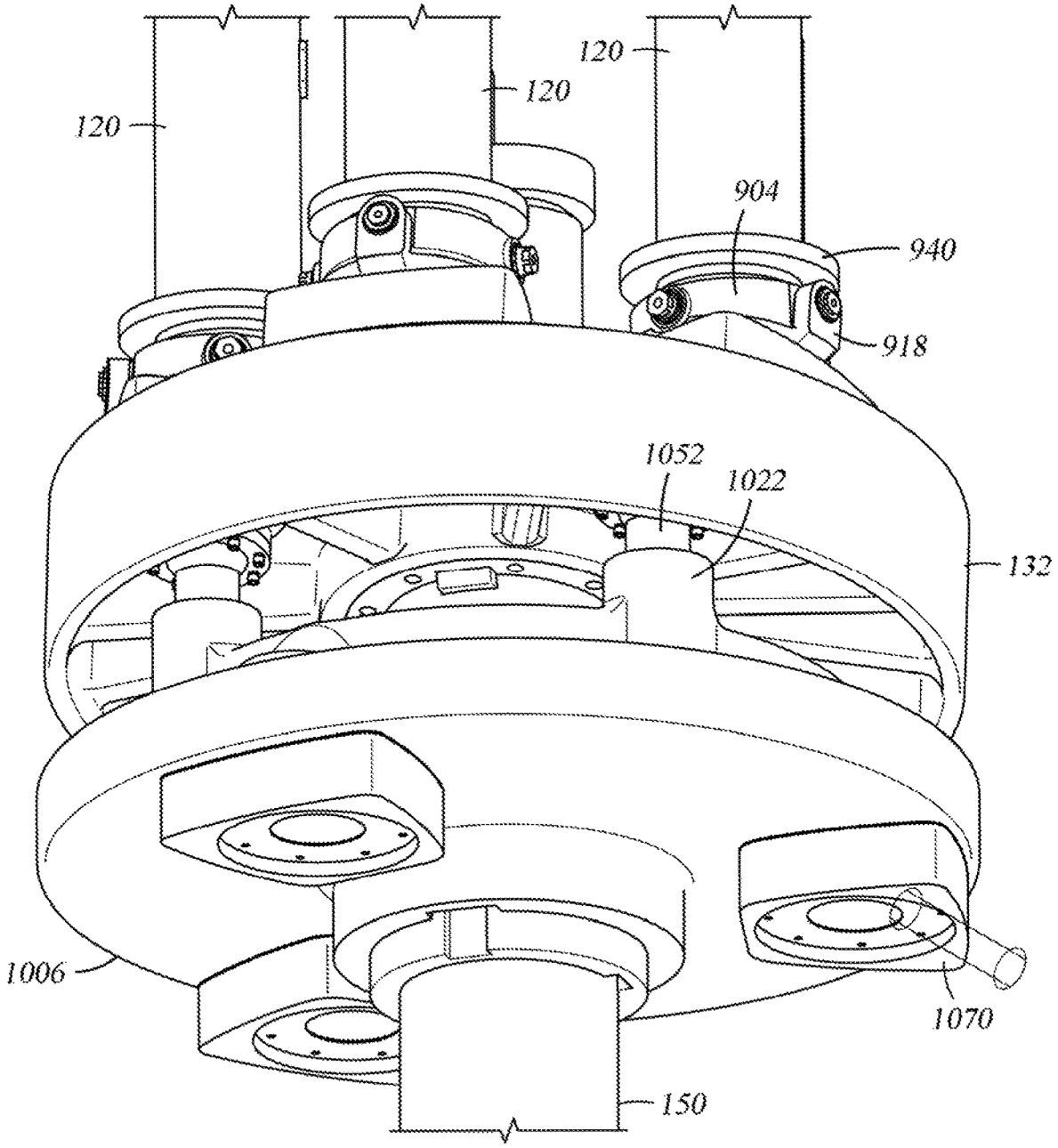
FIG. 10C is a perspective bottom view of the tilt actuator assembly of FIG. 10A.

FIG. 10C is a plan view of the tilt disk assembly 1000 from the side opposite the gusset 1014. Shown here are three slipper shoes 1070 for engaging hydraulic actuators (not shown) with the tilt disk 1054. These slipper shoes 1070 are similar to the slipper shoes 604 and 422 of FIGS. 6 and 4, respectively. The slipper shoes 1070 are distributed at equal angular displacements around the circumference of the tilt disk 1054. Each slipper shoe 1070 has a lubrication system similar to that of the tilt pads 902, as shown in FIG. 9D. The distribution of the hydraulic actuators at equal angular displacements, along with the distribution of the thruster rods 1052 at two locations, along with the gusset 1014 (FIG. 10B), spreads the load on the tilt disk 1054 to avoid excessive point stresses as the tilt disk 1054 rotates with the wobble plate 132.

FIG. 11A is a schematic cross-sectional view of a pump 1100 according to another embodiment. The pump 1100 of FIG. 11A has a tilt actuator assembly 1102 that includes a cylindrical hydraulic 1112 similar to the cylindrical hydraulic 502 of FIG. 5. Here, however, a cylindrical thruster 1113 is coupled to a thrust plate 1114 that drives a crosshead 1102 to move axially along the drive shaft 150. The crosshead 1120 is rotationally decoupled from the cylindrical hydraulic 1112 by a thrust bearing 1118, such that the crosshead 1102 rotates with the drive shaft 150. The crosshead 1102 is coupled to the second surface 302 of the wobble plate 132 by a clevis linkage 1104. The crosshead 1102 is another example of a slider.

The clevis linkage 1104 is rotatably fastened to opposite sides of the crosshead 1102 and to an attachment point 1119 on the second surface 302 of the wobble plate 132. The attachment point 1119 may include a bracket or hinge 1110 to which the clevis linkage 1104 can be pinned. The clevis linkage 1104 can rotate about the pin as the wobble plate 132 tilt angle changes. The guide ring 406 and key 408 are also used.

FIG. 11B is an isometric view of the tilt actuator assembly 1102 of the pump 1100 of FIG. 11A. The clevis linkage 1104 that connects the crosshead 1102 to the wobble plate 132 is pinned at the attachment point 1119. The clevis linkage 1104 is a thruster that is curved to spread loads with a first portion 1154 of the clevis linkage 1104 being substantially circular and a second portion 1107 of the clevis linkage 1102 being attached to the first portion 1154 near a mid-point 1158 of the first portion 1154. The second portion 1107, in this case, is a short stub that provides connection of the clevis linkage 1102 to the attachment point 1119. The first portion 1154 of the clevis linkage 1102 has a first leg 1159 and a second leg 1160 opposite the first leg 1159. Each of the first leg 1159 and the second leg 1160 connects to the crosshead 1102 by a pinned connection. The clevis linkage 1104 transfers the axial hydraulic force applied to the crosshead 1102 to the attachment point 1119 of the wobble plate 132 to adjust the tilt angle thereof. The clevis linkage 1104 may also have optional counterweight portions 1120. The crosshead 1102 has an interior surface 1122 that has a slot 1124 for engaging with the drive shaft 150.

While the foregoing is directed to embodiments of the invention, other and further embodiments of the invention may be devised without departing from the basic scope thereof.

What is claimed is:

1. A pump, comprising:
a drive shaft coupled to a drive;
a wobble plate attached to the drive shaft by a swivel mount with a wobble plate key extending radially outward from the swivel mount;
a plurality of displacement rods, each having a first end and a second end, with the first end of each displacement rod disposed against a first surface of the wobble plate and the second end of each displacement rod connected with a plunger; and
a tilt actuator assembly disposed around the drive shaft, the tilt actuator assembly comprising a slider having an interior surface with a slot formed therein and a thruster coupled to the slider and extending toward a second surface of the wobble plate opposite the first surface, the tilt actuator assembly further comprising a key extending radially outward from the drive shaft and mated with the slot and a linear actuator slidably disposed against the slider.

2. The pump of claim 1, further comprising a thrust bearing between each displacement rod and the wobble plate.

3. The pump of claim 1, wherein the swivel mount is ball-shaped.

4. The pump of claim 3, wherein the swivel mount has a key slot parallel to the drive shaft, and the wobble plate key is a removable member that fits within the key slot.

5. The pump of claim 4, further comprising a retainer plate that contacts the wobble plate and the swivel mount.

6. The pump of claim 1, further comprising a bearing plate between the wobble plate and the fluid manifold, the bearing plate having a bore for each displacement rod and a bearing disposed in each bore.

7. The pump of claim 1, wherein the slider is a crosshead attached to the drive shaft by a guide ring.

8. The pump of claim 2, wherein the linear actuator comprises a hydraulic actuator.

9. The pump of claim 1, further comprising a thrust bearing between the linear actuator and the slider.

10. The pump of claim 1, wherein manipulation of the tilt actuator assembly adjusts the stroke length of the pump.

11. The pump of claim 1, wherein manipulation of the tilt actuator assembly adjusts the pump flow rate with constant drive shaft input speed.

12. A pump, comprising:
a drive shaft coupled to a drive;
a wobble plate attached to the drive shaft by a ball-shaped swivel mount with a wobble plate key extending radially outward from the swivel mount;
a plurality of displacement rods, each having a first end and a second end, with the first end of each displacement rod disposed against a first surface of the wobble plate and the second end of each displacement rod connected with a plunger; a thrust bearing between each displacement rod and the wobble plate;

a tilt actuator assembly disposed around the drive shaft, the tilt actuator assembly comprising a slider with a slot formed therein and a thruster extending toward a second surface of the wobble plate opposite the first surface;

a key extending radially outward from the drive shaft and mated with the slot; and a rack-pinion actuator slidably disposed against the slider.

13. The pump of claim 12, wherein the swivel mount has a key slot parallel to the drive shaft, and the wobble plate key is a removable member that fits within the key slot.

14. The pump of claim 13, further comprising a retainer plate that contacts the wobble plate and the swivel mount.

15. The pump of claim 14, wherein the tilt actuator assembly comprises a thruster extending toward the second surface of the wobble plate.

16. The pump of claim 15, wherein the wobble plate comprises a cylindrical rim with a central axis and an elliptical plate attached to the cylindrical rim, and the elliptical plate is not perpendicular to the central axis.

17. The pump of claim 12, further comprising a fluid head;

wherein the fluid head comprises:

a module assembly for each displacement rod, each module assembly comprising:

a suction valve cartridge;

a discharge valve cartridge; and a discharge conduit, and;

a discharge manifold, wherein each discharge conduit is connected to the discharge manifold.

18. The pump of claim 12, wherein the pump is a hydraulic fracturing pump.

19. A pump, comprising:

a drive shaft coupled to a drive;

a wobble plate attached to the drive shaft by a ball-shaped swivel mount with a wobble plate key extending radially outward from the swivel mount;

a plurality of displacement rods, each having a first end and a second end, with the first end of each displacement rod disposed against a first surface of the wobble plate and the second end of each displacement rod connected with a plunger; a thrust bearing between each displacement rod and the wobble plate;

a tilt actuator assembly disposed around the drive shaft, the tilt actuator assembly comprising a slider with an interior surface that has a slot formed therein and a thruster extending toward a second surface of the wobble plate opposite the first surface, the slider attached to the drive shaft by a guide ring;

a key extending radially outward from the drive shaft and the guide ring, and mated with the slot; and a hydraulic actuator slidably disposed against the slider.

20. The pump of claim 19, wherein the swivel mount has a key slot parallel to the drive shaft, and the wobble plate key is a removable member that fits within the key slot.

21. The pump of claim 19, wherein the pump is able to pump slurries, compressible fluids, and/or incompressible fluids.

* * * * *